United States Patent [19]

Happ et al.

[11] Patent Number: 4,703,147

[45] Date of Patent: Oct. 27, 1987

[54] PROBE ACTUATED SWITCH

[75] Inventors: Lawrence R. Happ, Mundelein; Gerald A. Stark, Winthrop Harbor; Stephen M. Drensky, Waukegan, all of Ill.

[73] Assignee: The Cherry Corporation, Waukegan, Ill.

[21] Appl. No.: 871,097

[22] Filed: Jun. 5, 1986

[51] Int. Cl.[4] ..... H05B 6/64

[52] U.S. Cl. ..... 219/10.55 C; 200/50 A; 200/61.62

[58] Field of Search ..... 200/1 A, 50 A, 61.62, 200/153 T; 219/10.55 C

[56] References Cited

U.S. PATENT DOCUMENTS

| | | | |
|---|---|---|---|
| 4,511,780 | 4/1985 | Okamura | 219/10.55 C |
| 4,528,430 | 7/1985 | Lewandowski et al. | 200/62 |
| 4,529,852 | 7/1985 | Lewandowski | 200/50 A |
| 4,547,634 | 10/1985 | Leger | 200/50 C |

*Primary Examiner*—A. D. Pellinen
*Assistant Examiner*—Morris Ginsburg
*Attorney, Agent, or Firm*—Willian Brinks Olds Hofer Gilson & Lione Ltd.

[57] ABSTRACT

A probe actutaed switch comprising a plurality of electrical contact blades and a first and second actuator for engagement with a first and second probe. The actuators are slidably mounted and positioned to engage selected ones of the contact blades. Each actuator defines a rest position and is biased to that rest position by selected contact blades. First and second probe guides are aligned for engagement with the first and second probes. Each guide is adapted to guide a respective probe into engagement with a respective actuator. A latch mechanism is positioned to releasably latch the first actuator in its rest position. As the probes are inserted into the respective probe guides, they are guided into engagement with the actuators. The second actuator is thereupon moved from its rest position to alter the electrical connections of selected ones of the plurality of contacts. The first actuator is held in its rest position until the first probe is fully inserted. The first actuator is then released by the latch and is rapidly moved from its rest position to alter the electrical connections of selected other ones of the plurality of contacts. When the probes are removed from the probe guides, the actuators return to their respective initial rest positions and the contact blades return to their respective initial electrical connections.

23 Claims, 27 Drawing Figures

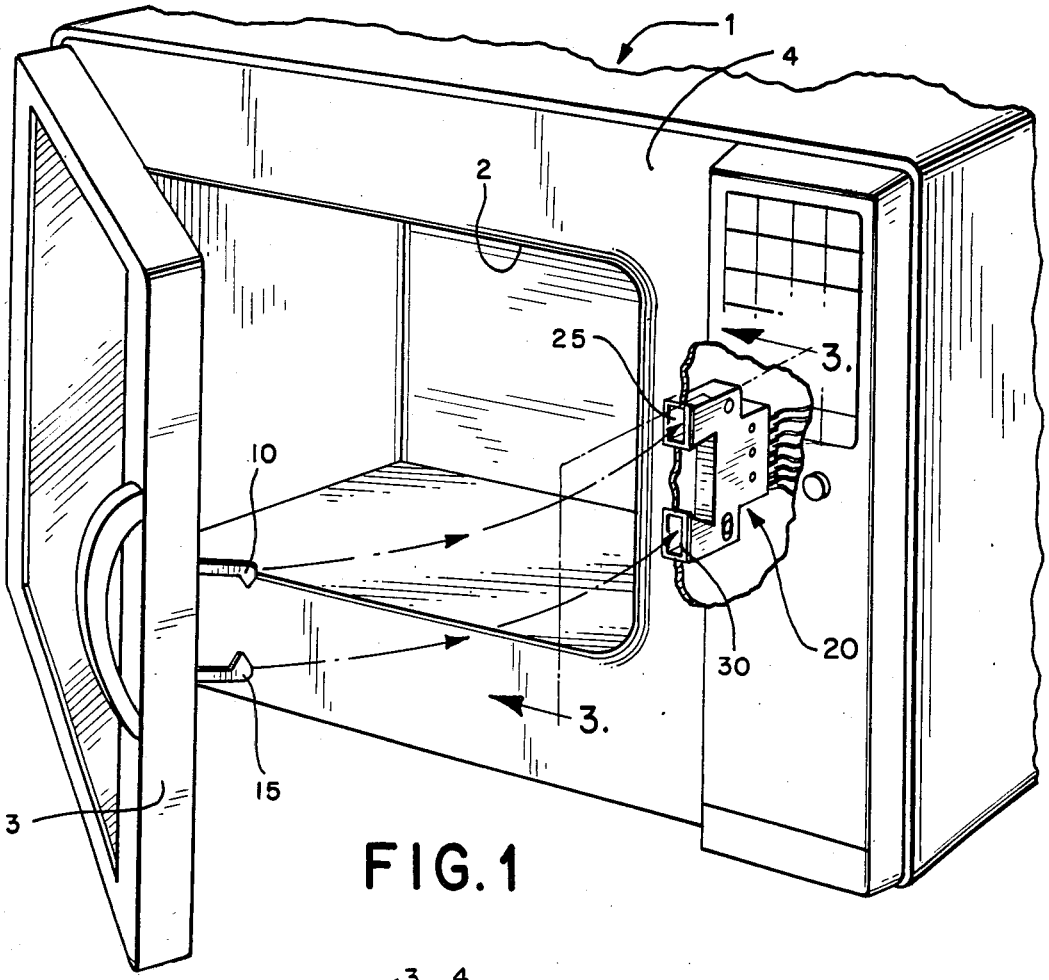
FIG. 1
FIG. 2
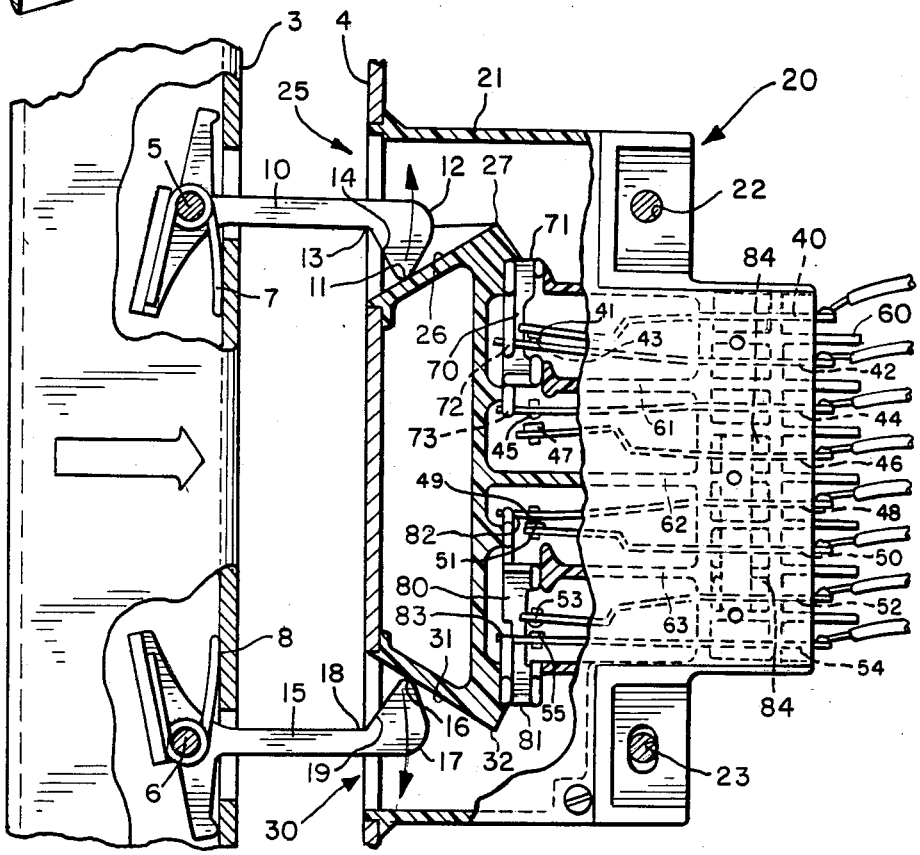

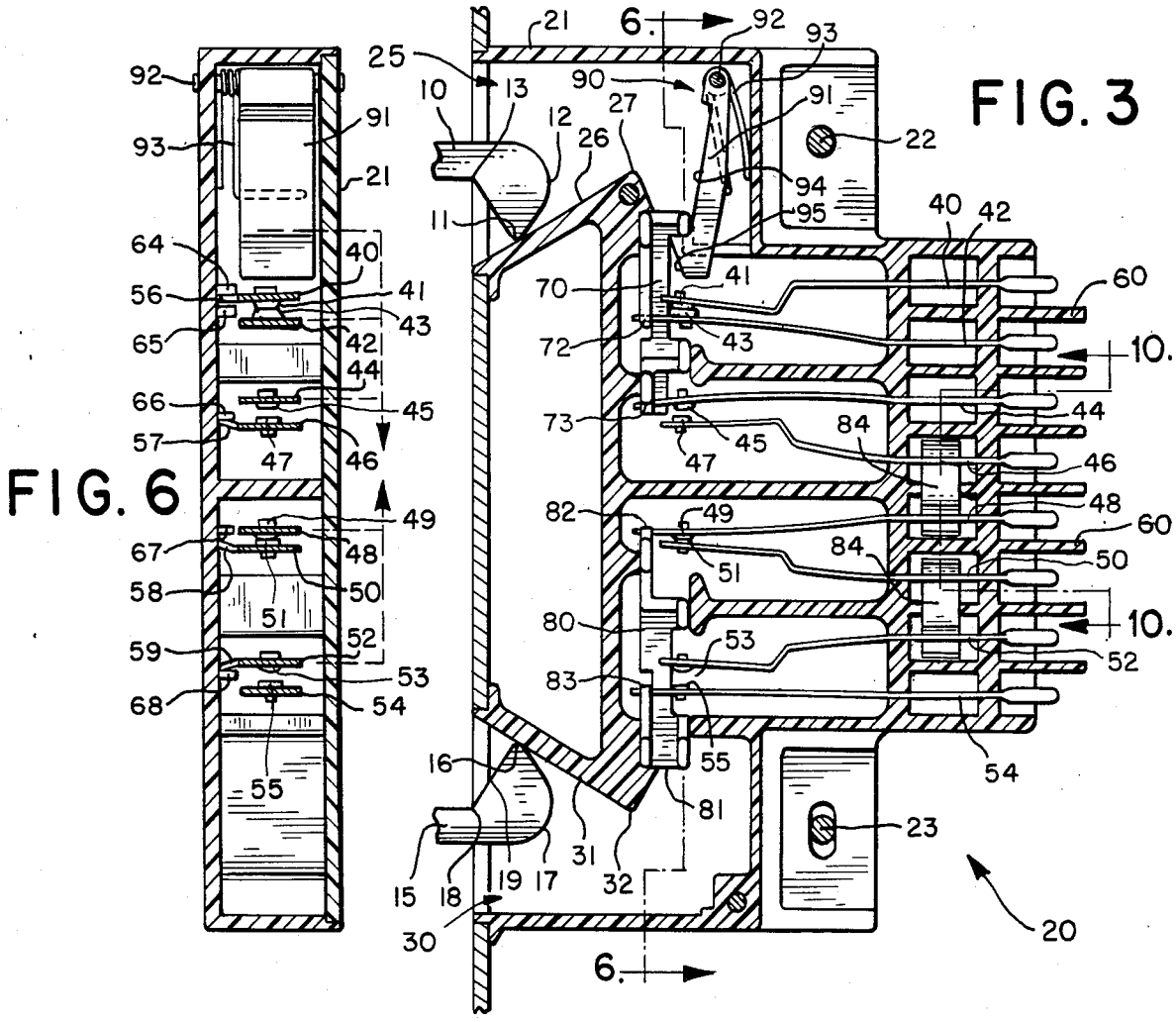
FIG. 5
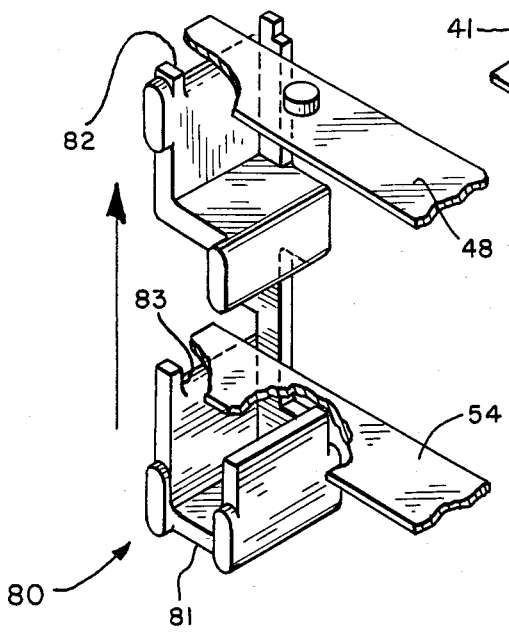
FIG. 3a
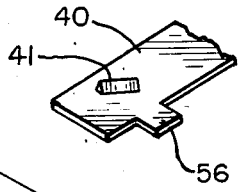
FIG. 4
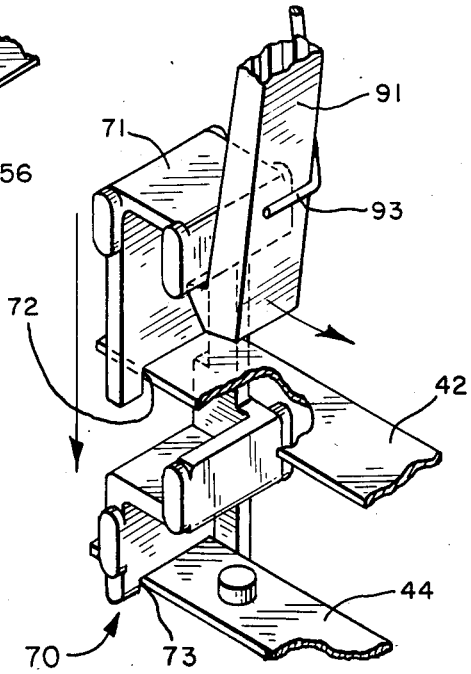

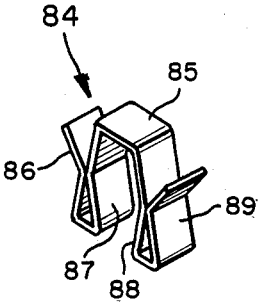
FIG. 9
FIG. 10
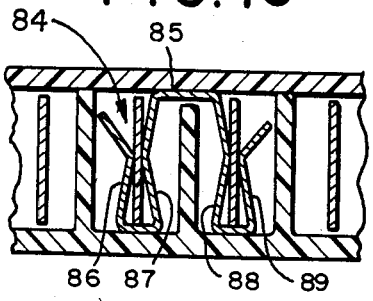
FIG. 11
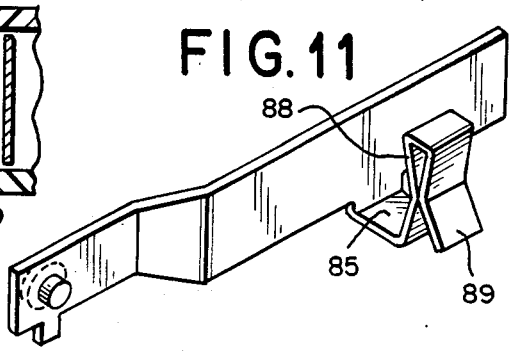
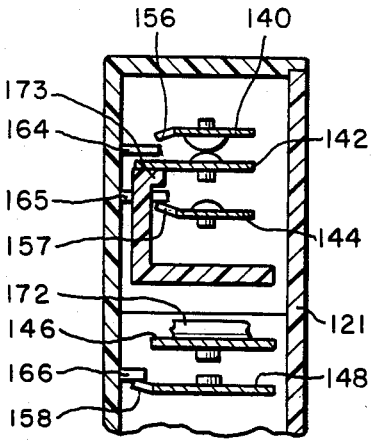
FIG. 12a
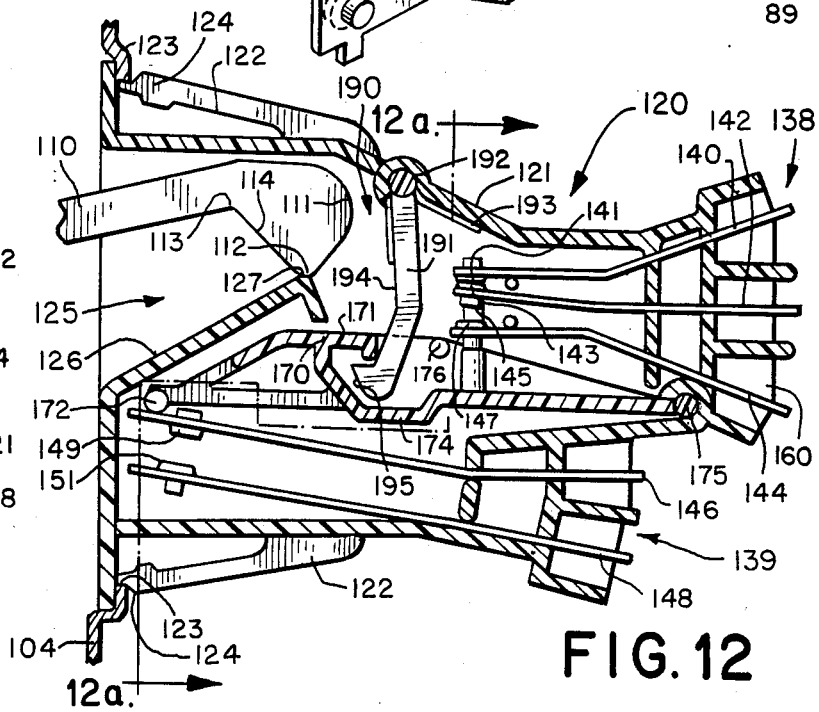
FIG. 12
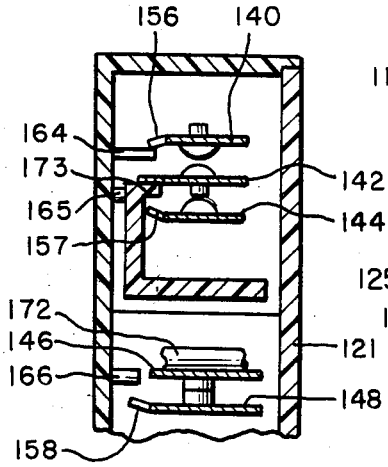
FIG. 13a
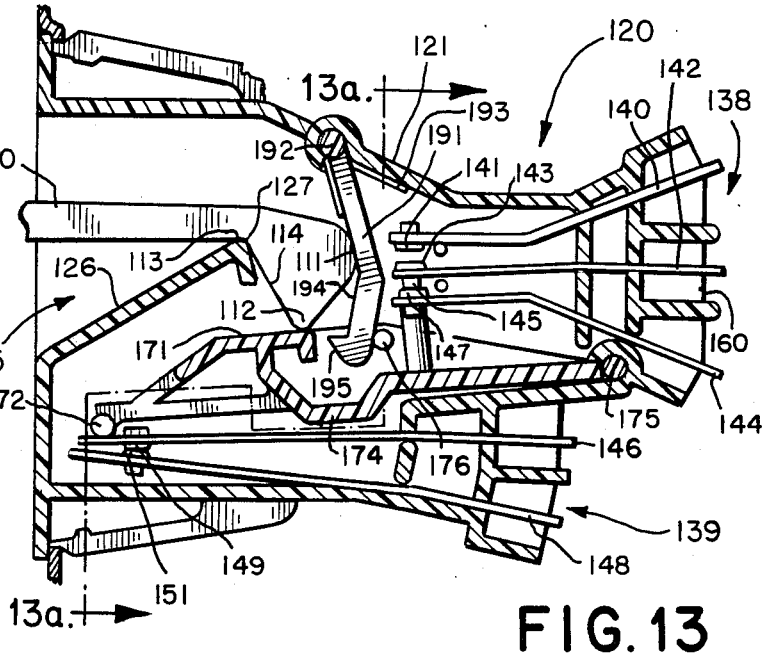
FIG. 13

PROBE ACTUATED SWITCH

BACKGROUND OF THE INVENTION

The present invention relates to a probe actuated interlock switch comprising a plurality of electrical contacts, at least one actuator positioned to engage at least one of the contacts, and at least one probe guide operative to guide the probe into engagement with the actuator.

Interlock switches are typically used in electrical appliances such as microwave ovens and photocopiers to prevent the appliance from performing various functions or to prevent the full energization of the appliance before certain conditions are satisfied. Such uses generally provide protection for both the operator and the appliance.

The interlock switch may be used to determine whether or not certain conditions have been fulfilled. In the case of a probe actuated interlock switch, the probe is disposed on the door of the oven or photocopier and is aligned to engage the switch. When the probe is fully inserted, the switch is actuated and supplies electrical power to the appliance. This type of interlock switch has proven highly reliable and is used in a variety of electrical appliances.

SUMMARY OF THE INVENTION

The present invention is directed to an interlock switch wherein at least one pair of electrical contacts is actuated and deactuated by means of at least one actuator and at least one probe.

According to the present invention, the switch comprises at least one probe guide adapted to receive at least one probe. The probe defines a first end which is biased to move in a first direction. As the probe is inserted into the switch, the first end of the probe is guided by the probe guide to move in opposition to the biasing force. Further insertion of the probe into the switch causes the probe to engage at least one actuator. The actuator is positioned to engage at least one of a plurality of electrical contacts such that movement of the actuator produces movement of the at least one contact. The movement of the contact causes the engagement or disengagement of at least one other electrical contact.

An advantage of the present invention is that the electrical connection of the contacts is modified only when the probe is substantially inserted into the switch.

Another advantage of the present invention is that the probe is guided by the probe guide to substantially prevent misengagement of the probe and actuator.

An advantage of a preferred embodiment of the present invention is that the electrical connections of a plurality of electrical contacts are electrically altered in a predetermined ordering.

Another advantage of a preferred embodiment of the present invention is that the probe guide is operative to releasably hold the probe once the probe is fully inserted into the probe guide.

Another advantage of a preferred embodiment of the present invention is that the electrical connections of a plurality of contacts are altered in a rapid manner.

Another advantage of a preferred embodiment of the present invention is that the actuator used to engage the electrical contacts is not visible by the switch user.

Another advantage of a preferred embodiment of the present invention is that the actuator of the electrical contacts operates to electrically isolate selected ones of the electrical contacts from the other electrical contacts.

Another advantage of a preferred embodiment of the present invention is that the probe actuated switch may be used in a safety circuit to interrupt electrical power to a circuit.

Another advantage of a preferred embodiment of the present invention is that each contact may be manufactured substantially identical to all other contacts of the switch.

An additional advantage of a preferred embodiment of the present invention is that a plurality of the electrical contacts are connected and disconnected in a wiping motion to substantially improve the reliability of the contacts.

BRIEF DESCRIPTION OF THE DRAWINGS

FIG. 1 is a perspective view of a microwave oven with a cut-away portion showing a first preferred embodiment of the present invention installed in the oven housing.

FIG. 2 is a sectional representation of a second preferred embodiment showing the door in the partially closed position.

FIG. 3 is a sectional representation of a first preferred embodiment showing the actuator latch mechanism and the door probes partially inserted into the probe guides.

FIG. 3*a* is a perspective view of one of the contact blades with a triangular shaped contact point and a tab.

FIG. 4 is a perspective view of the upper actuator and actuator latch mechanism of the first preferred embodiment.

FIG. 5 is a perspective view of the lower actuator of the first preferred embodiment.

FIG. 6 is a cross sectional representation of the first preferred embodiment of FIG. 3 taken along lines 6—6.

FIG. 9 is a perspective view of an electrical connector used in the first and second preferred embodiments shown in FIGS. 2 and 3.

FIG. 10 is a sectional representation of the electrical connector of FIG. 9 installed on two electrical contact blades.

FIG. 11 is a perspective view of a contact blade with integral electrical connector.

FIG. 12 is a sectional representation of a third preferred embodiment of the present invention shown with the door probe partially inserted into the probe guide.

FIG. 12*a* is a sectional representation of the preferred embodiment of FIG. 12 taken along lines 12*a*—12*a*.

FIG. 13 is a sectional representation of the embodiment of FIG. 12 shown with the door probe fully inserted into the probe guide.

FIG. 13*a* is a sectional representation of the preferred embodiment of FIG. 13 taken along lines 13*a*—13*a*.

FIG. 20 is a schematic representation of an electrical circuit showing how the multiple contacts of the third, fourth, fifth and sixth preferred embodiments of the present invention could be electrically connected.

DETAILED DESCRIPTION OF THE PREFERRED EMBODIMENTS OF THE PRESENT INVENTION

Figure 7:
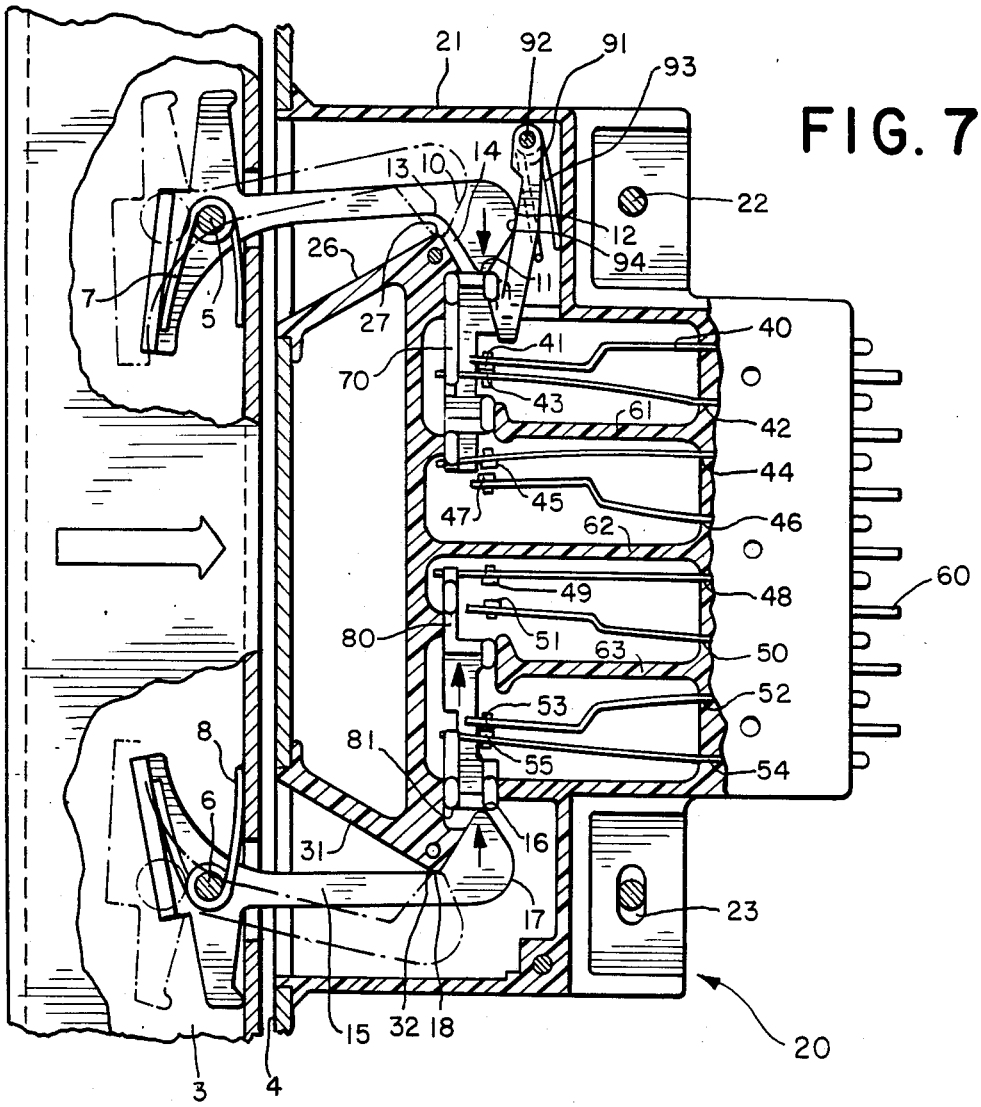
FIG. 7 is a sectional representation of the first preferred embodiment showing the door probes being inserted into the switch and engaging the actuators and actuator latch mechanism.

Turning now to the drawings, FIG. 1 is a perspective view of a microwave oven 1. The cut-away portion shows a first preferred embodiment of the present invention generally represented as a switch 20.

The microwave oven 1 comprises a microwave chamber 2 for the heating of food items (not shown) by microwave radiation. A door 3 is hingeably mounted to the oven 1 and is adapted to substantially seal against the door jamb 4 to prevent radiation from escaping the heating chamber 2. The door 3 is releasably held in this position by the engagement of an upper and lower door probe 10, 15 with the interlock switch 20.

FIG. 3 is a sectional representation taken along the line 3—3 of FIG. 1. Each door probe 10, 15 comprises a first bearing surface 11, 16, a second bearing surface 12, 17, a third bearing surface 13, 18 and a fourth bearing surface 14, 19 for engagement with the switch 20. The door probes are pivotally mounted on the door 3 by pivot pins 5, 6, with the region between the probes 10, 15 defining an inward and outward direction. The probes 10, 15 are biased inwardly by biasing springs 7, 8, respectively and, when fully inserted into the switch 20, are operative to actuate the switch 20.

The switch 20 is positioned and aligned to engage the door probes 10, 15 and comprises a housing 21 with mounting apertures 22, 23 for attaching the switch 20 to the oven 1. The housing 21 defines a back cover and a front cover which is shown removed in FIG. 3. The switch 20 further comprises upper and lower probe guides 25, 30. Each guide 25, 30 is adapted to receive the respective door probe 10, 15 and comprises an outwardly sloping guide surface 26, 31 and a guide crest 27, 32. The outwardly sloping guide surfaces 26, 31 are integral with the housing 21 and cooperate with the biasing springs 7, 8 to guide the probes 10, 15 outwardly during insertion and inwardly during removal of the probes 10, 15. The guide crests 27, 32 are also integral with the housing 21 and cooperate with the biasing springs 7, 8 and bearing surfaces 14, 19 to guide the probes 10, 15 inwardly during insertion and outwardly during removal of the probes 10, 15.

The switch 20 comprises four pairs of electrical contact blades. The first pair consists of contact blades 40, 42; the second pair consists of contact blades 44, 46; the third pair consists of contact blades 48, 50; and the fourth pair consists of contact blades 52, 54. Each contact blade 40, 42, 44, 46, 48, 50, 52, 54 is formed from flexible, electrically conductive material and defines a first and second end. The first end of each contact blade 40, 42, 44, 46, 48, 50, 52, 54 comprises a contact point 41, 43, 45, 47, 49, 51, 53, 55, respectively.

FIG. 6 is a sectional view taken along line 6—6 of FIG. 3 and shows the position of the contact blades and points with respect to one another. The contact points 41, 43, 45, 47, 49, 51, 53, 55 are oriented on the respective blades such that the contact points of each pair are aligned and face opposite one another. The contact points 41, 43 are wedge shaped and are oriented with respect to each other in a substantially "X" configuration upon engagement. The contact point 41 is shown more clearly in FIG. 3*a*. Although the wedge shape reduces the contact area of the points, the pressure of the contact is increased. This type of contact point is particularly advantageous for low voltage, low current applications. The contact points 45, 47, 49, 51, 53, 55 are cylindrical button shaped contacts commonly used in the industry.

The first ends of the contact blades 40, 46, 50, 52 comprise tabs 56, 57, 58, 59. The tabs extend toward the back cover of the housing 21 for engagement with stop pins 64, 65, 66, 67, 68. The stop pins 64, 65, 66, 67, 68 protrude from and are integral with the back cover of the housing 21. Each tab, other than tab 56, is slightly bent in the direction of the respective stop pin such that the bottom region of the tab is the area engaged by the stop pin. The tab 56 is straight and sandwiched between the stop pins 64, 65 to substantially prevent movement of the contact blade 40. The contact blades 46, 50 are shaped and positioned such that they are biased in the upward direction. The stop pins 66, 67 are operative to limit the amount of upward travel of the blades 46, 50 by engagement with the tabs 57, 58, respectively. The contact blade 52 is shaped and positioned such that it is biased in the downward direction. The stop pin 68 is operative to limit the amount of downward travel of the blade 52 by engagement with the tab 59. The height of the stop pins 64, 65, 66, 67, 68 and the magnitude of the biasing is selected such that each contact blade 40, 46, 50, 52 is temporarily twisted about its longitudinal axis when engaged by the respective stop pin. The contact blades 40, 46, 50, 52 untwist when by the respective contact blades 42, 44, 48, The twisting motion reduces the degree of contact and thereby increases the reliability of the contact.

The flexing ability of the contact blades 44, 46, 48, 50, 52, 54 allows the respective contact points 45, 47, 49, 51, 53, 55 to slide across one another during connection and disconnection. The sliding movement results in a more stable electrical connection and substantially reduces damage to the contact points arising from possible electrical arcing.

The region proximate the second end of each contact blade 40, 44, 46, 48, 50, 52, 54 is firmly held by the housing 21. The second ends of the contact blades 40, 42, 44, 48, 50, 52, 54 extend rearwardly from the housing 21 a sufficient distance to allow for electrical connection. Insulating barriers 60, integral with the housing 21, extend between each extending second end 40, 42, 44, 46, 8, 50, 52, 54 and are operative to substantially isolate the electrical connections.

Two electrical connectors 84 connect the contact blades 46, 48 50, 52 in the interior of the casing 21. The connectors 84, shown in detail in FIGS. 9 and 10, are formed from flexible, electrically conductive material. The connectors 84 each comprise a first pair of opposing leafs 86, 87 and a second pair of opposing leafs 88, 89 integrally connected by a bridge 85. The forces generated by the opposing leafs 86, 87, 88, 89 hold the connectors 84 in position on the contact blades 46, 48, 50, 52. The holding forces of connectors 84 are increased slightly due to exerted on the leafs 86, 89 from the inner walls of the housing 21. The use of the connectors 84 internal to the switch reduces the number of electrical connections external to the switch.

Electrical isolation, interior to the switch 20, is provided by insulating barriers 61, 62, 63. The insulating barrier electrically isolates the first pair of contacts 40, 42 from the second pair of contacts 44, 46; the insulating barrier 62 electrically isolates the second of contacts 44, 46 from the third pair of contacts 48, 50; and the insulating barrier 63 electrically isolates the third pair of contacts 48, 50 from the fourth pair of contacts 52, 54.

An upper slide actuator 70, FIG. 4, is positioned in the upper portion of the housing 21 for engagement with the upper door probe 10 when the door 3 is in the substantially closed position. Similarly, a lower slide actuator 80, FIG. 5, is positioned in the lower portion of the housing 21 for engagement with the lower door probe 15 also when the door 3 is in the substantially closed position. The actuators 70, 80 are positioned with respect to the probe guides 25, 30 so as not to be visible from outside the oven 1. This feature of a hidden actuator is common to all of the preferred embodiments discussed below. Each actuator 70, 80 comprises a bearing surface 71, 81 adapted for engagement with the door probe bearing surface 11, 16. The actuators 70, 80 are mounted in the housing 21 to be slidable inwardly to an actuated position and outwardly to a rest position.

The upper slide actuator 70 is adapted to engage the contact blades 42, 44 and comprises curved bearing surfaces 72, 73 for engaging the respective first ends of the contact blades 42, 44. The lower slide actuator 80 is adapted to engage the contact blades 48, 54 and comprises curved bearing surfaces 82, 83 for engaging the first ends of the contact blades 48, 54. The contact blades 40, 42, 44, 46, 48, 50, 52, 54 are and positioned with respect to the actuators 70, 80 such that, when in the rest position, the actuator 70 engages the contact blade 44 and the actuator 80 engages the contact blade 54. The biasing forces by the contact blades 44, 54 are sufficient to the upper and lower slide actuators 70, 80 in their respective rest positions when the actuators 70, 80 are not substantially engaged by the door probes 10, 15.

A latch mechanism 90 is used to latch the upper actuator 70 in its rest position. The latch mechanism 90 comprises a latch 91, a pivot pin 92 and a biasing spring 93. The latch 91 is pivotally mounted to the housing 21 by means of the pivot pin 92 and may be pivoted between a locking and an unlocking position. The biasing spring 93 is positioned between the housing 21 and the latch 91 is operative to bias the latch 91 to the locking position. The latch 91 is adapted and positioned with respect to the upper slide actuator 70 to releasably the actuator 70 in its rest position when the door 3 is not fully closed. The latch 91 comprises bearing 94, 95 adapted for engagement with the door probe 10 actuator 70.

Figure 19:
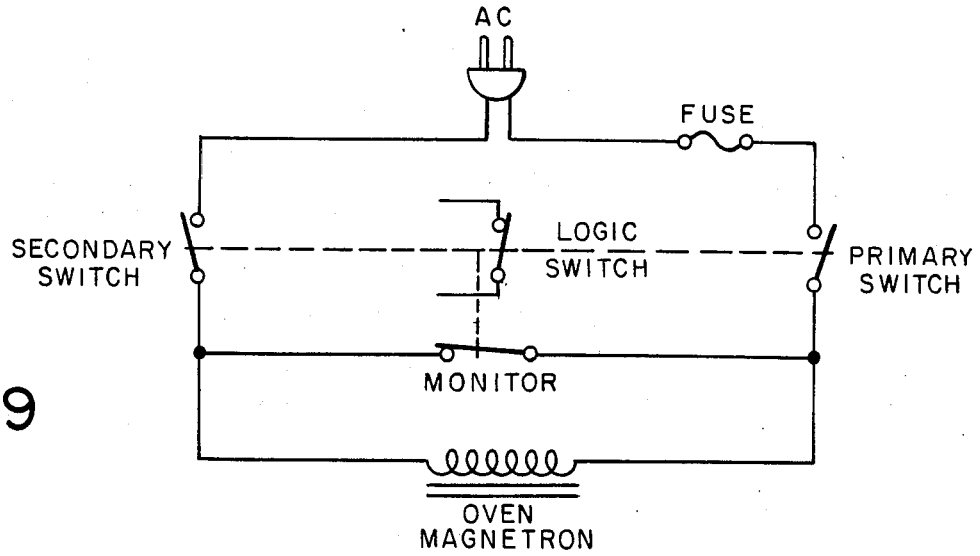
FIG. 19 is a schematic diagram of an electrical circuit showing how the multiple contacts of the first and second preferred embodiments of the present invention could be electrically connected.

The switch 20 is electrically connected in the microwave oven 1 represented in FIG. 19. The dotted lines joining various switches represent the mechanical connection with the oven door. The contact blades 48, 50 as a safety monitor switch; the contact blades 52 function as a secondary power switch; the contact blades 44, 46 function as a primary power switch; and blades 40, 42 function as a logic switch. The logic switch supplies power to various logic circuitry (not shown) in the oven 1. The latch mechanism 90 the spacings between the contact blades determine order of the electrical connections when the switch 20 is actuated and deactuated. When the switch 20 actuated, the contact blades 48, 50 open first; the contact blades 52, 54 close second; the contact blades open third; and the contact blades 44, 46 close last. When the switch 20 is deactuated, the electrical connections are altered in the reverse order.

Thus, in powering the oven 1 by means of the switch 20, the monitor switch is opened, the secondary switch closed and the primary switch is closed. The duplicative of the secondary and primary switches is provided for safety reasons. Under normal operation, only the switch is operated under high voltage, high current conditions. If the contact blades 44, 46 should become welded closed, the secondary switch may be relief upon to prevent the electrical power from being applied to the oven magnetron when the door is opened. If contact blades 52, 54 also become welded closed, the switch is circuited to electrically bypass the magnetron, blow the fuse and thereby prevent electrical power from being applied to the magnetron until the oven is serviced.

When the door 3 is in the opened position, the upper and lower actuators 70, 80 are biased to their respective positions by the contact blades 44, 54 and the 70 is locked in place by the latch 91. In this the first pair of contact blades 40, 42 are electrical contact; the second pair of contact blades 44, 46 are not in electrical contact; the third of contact blades 48, 50 are in electrical contact; and the fourth pair of contact blades 52, 54 are electrical contact.

As the door 3 is swung from the opened to the closed position, FIG. 3, the door probes 10, 15 enter the probe guides 25, 30 and are guided outwardly by the guide surfaces 26, 31 against the biasing force of the springs 7, 8. The movement of the door probes 10, 15 continues bearing surfaces 11, 16 of the probes 10, 15 pass over the crests 27, 32. The probe bearing surfaces 14, 19 are then engaged by the guide crests 27, 32 which allow the probes 10, 15 to move inwardly and engage the bearing surfaces 71, 81 of the actuators 70, 80 as shown in FIG. 7. The biasing forces of the springs 7, 8 are sufficient to overcome the biasing forces the contact blades 42, 44, 48, 54. The lower actuator 80 therefore moves inwardly as the probes 10, 15 further into the switch 20. The upper actuator 70 continues to be held in its rest position against force of the probe 10 by the latch 91.

Figure 8:
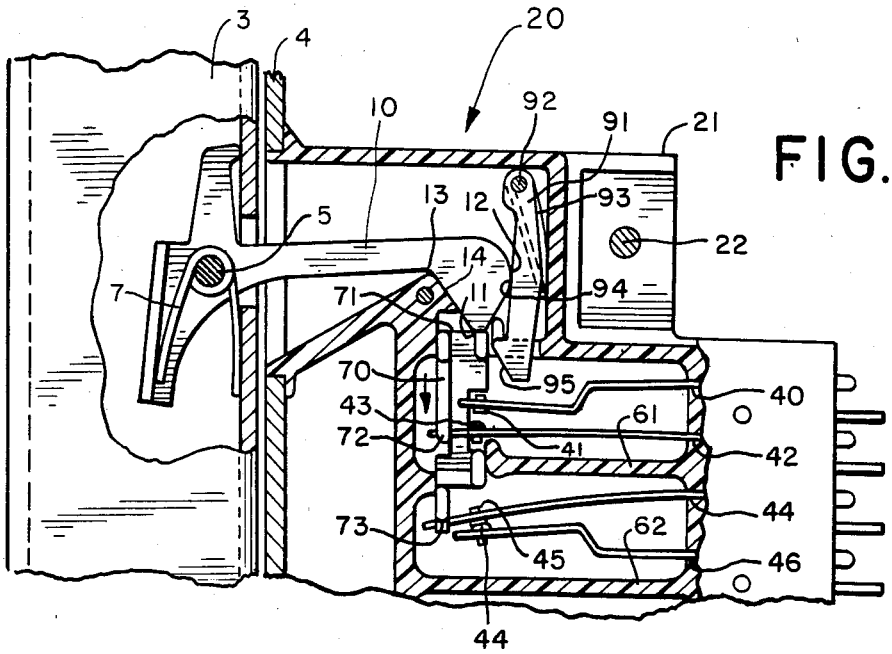
FIG. 8 is a sectional representation of the upper portion of the first preferred embodiment showing the upper door probe in the fully inserted position.

Upon further insertion of the probes 10, 15, the bearing surface of the upper probe 10 engages the bearing surface of the latch 91 and forces the latch 91 to pivot rearwardly about the pivot pin 92. At substantially the same time, the lower probe 15 moves the lower actuator 80 to its fully actuated position. Once the probe 10 is fully inserted, the upper actuator 70 is released and quickly snaps into its actuated position under the force applied by the upper probe 10. The surfaces 13, 18 of the probe 10, 15 are engaged by the crests 27, 32 thereby preventing the probe 10, 15 from unnecessary further inward movement, as in FIG. 8.

The latch mechanism 90 in cooperation with the shape and position of the contact blades allows the electrical connection of the third pair of contact blades 48, 50 (monitor ) to be broken first; then the electrical connection of the fourth pair of contact blades 52, 54 (secondary) to be established; next the electrical connect of the first pair of contact blades 40, 42 (logic) to be broken; and finally the electrical connection of the second pair of contact blades 44, 46 (primary) to be established. The latch mechanism 90 allows the electrical connections of the contact blades 40, 42 and 44, 46 to be altered in a rapid manner. The electrical connections substantially reduce the possible electrical arcing between the contacts and increases the lifetime of the contact points 45, 47.

When the door 3 is opened, the probe bearing surfaces 14, 19 engage the guide crests 27, 32 and are guided outwardly. The outward movements of the probes 10, 15 allow the latch 91 to pivot forewardly and the actuators 70, 80 to move outwardly under the biasing forces of the contact blades 42, 44, 48, 54. As the upper actuator 70 moves outwardly, it engages the bearing surface 95 of the latch 91 forcing the latch 91 to pivot rearwardly the pivot pin 92. The outward movement of the actuator 70 continues until the actuator 70 reaches it position. The latch 91 is then free to pivot, the influence of the spring 93, to lock the actuator 70 in its rest position.

The upward movement of the actuator 70 causes the contact blades 42, 44, 46, 48, 50, 52, 54 to return to their rest positions. The alterations of the electrical connections follows the predefined order due to the shape and position of the blades as discussed above. The contact blades 44, 46 (primary) are disconnected first; then the contact blades 40, 42 (logic) are connected; next the contact blades 52, 54 (secondary) are disconnected; and finally the contact blades 48, 50 (monitor) are connected.

The second preferred embodiment is substantially similar to the first preferred embodiment. All like structure will therefore be designated by like reference numerals, except where noted. The second preferred embodiment of the present invention is shown in FIG. 2 and is generally represented as switch 20. The switch 20 of the second preferred embodiment differs primarily from the switch 20 of the first preferred embodiment in that the second preferred embodiment does not comprise the latch mechanism 90.

One of the functions of the latch mechanism 90 is to delay the actuator 70 a sufficient amount of time to allow the lower actuator 80 to alter the electrical connections of the blades 48, 50, 52, 54 before the upper actuator can alter the electrical connections of the blades 40, 42, 44, 46. This delay is performed in the second embodiment by shortening the distance between the bearing surface 81 and the crest 32 in comparison to the distance between the bearing surface 71 and the 27. The difference in the distances is slight compared with the overall distance and is represented in FIG. 2. The difference is sufficient to enable the lower door probe 15 to engage the lower actuator 80 before the upper door probe 10 engages the upper actuator 70. This enables the lower actuator 80 to alter the electrical connections of the blades 48, 50, 52, 54 before the upper actuator 70 alters the electrical connections of the blades 40, 42, 44, 46.

When the door 3 is in the substantially open position, the door probes 10, 15 are not engaged with the probe guides 25, 30 and the upper and lower slide actuators 70, 80 in their respective rest positions. In this position, first pair of contact blades 40, 42 are in electric contact; the second pair of contact blades 44, 46 are in electrical contact; the third pair of contact blades 48, 50 are in electrical contact; and the fourth pair of contact blades 52, 54 are not in electrical contact.

As the door 3 is swung from the opened to the closed position, the bearing surfaces 11, 16 of the door probes 10, 15 the guide surfaces 26, 31 of the probe guides 25, 30. The guide surfaces 26, 31 guide the door probes 10, 15 outwardly such that the probes 10, 15 pivot their respective mounting pins 5, 6 against the force of the biasing springs 7, 8. The probes 10, 15 are guided outwardly by the guide surfaces 26, 31 until the bearing surfaces 11, 16 move over the crests 27, 32 of the respective guides 25, 30. The probe bearing surfaces 14, 19 thereupon engage the guide crests 27, 32 allow the probes 10, 15 to move inwardly.

Once the door 3 is substantially closed, the bearing surface 16 engages the bearing surface 81 before the bearing surface 11 engages the bearing surface 71. The biasing forces of the probe springs 7, 8 are sufficient to overcome the combined biasing forces of the contact blades 42, 46, 54 such that the actuators 70, 80 slide inwardly. The lower actuator 80 is moved upwardly by the probe 15 before the upper actuator 70 is moved downwardly. The upward movement of the actuator 80 forces the contact blades 48, 54 to flex inwardly. The contact blade 48 is moved away from the contact blade 50 and the blade 54 is moved toward engagement with the contact blade 52. The positioning of the contact blades 48 and 54 with respect to the actuator 80 is such that the contact blade 48 is flexed away from the contact blade 50 before the contact blade 54 is electrically connected with the contact blade 52. Similarly and slightly later in time, the inward movement of the actuator 70 forces the contact blades 42, 44 to flex inwardly. The contact blade 42 is flexed away from contact 40 and the contact blade 44 is flexed toward engagement with the contact blade 46. The positioning of the contact blades 42 and 44 with respect to the actuator 70 is such that the contact blade 42 is flexed away from the contact blade 40 before the contact blade 44 is flexed into electrical contact with the contact blade 46.

When the door 3 is completely closed, the bearing surfaces 13, 18 of the probes 10, 15 are engaged by the crests 27, 32, preventing unnecessary further inward movement of the probes 10, 15. At this point, electrical between the first pair of contact blades 40, 42 has been interrupted and electrical contact between the second pair of contact blades 44, 46 has been established. Additionally, electrical contact between the third pair of contact blades 48, 50 has been interrupted and electrical contact between the fourth pair of contact blades 52, 54 has been established.

When the door 3 is swung from the closed to the opened position the probes 10, 15 are guided outwardly by engagement of the probe bearing surfaces 14, 19 with the guide 27, 32. The actuators 70, 80 are then returned to their rest positions under the biasing forces of the respective contact blades 42, 44, 48, 54. The movement of the actuators 70, 80 causes the electrical contact between the contact blades 44, 46 and 52, 54 to be broken and electrical contact between the contact blades 40, 42 and 48, 50 to be reestablished in an order reverse to that described for the door closing.

A third, fourth, fifth and sixth preferred embodiment will now be described. When these embodiments are used in microwave ovens at least two door probes and two switches are required. These embodiments describe the use of two separate switches which allow the spacing between the switches to be wide and variable. These are desirable features in oven design. (When used on the other devices, a single switch will provide many of the safety features as described herein). In such cases, two switches are used. However, for purposes of clarity, the following discussion will, in general, refer to only one of the switches and door probes. Although the two probes still define an inward and outward direction, reference will instead be made to upward and downward direction due to the fact that only one probe is depicted in the accompanying figures.

The third preferred embodiment is shown in FIGS. 12 and 13 and generally represented as switch 120. The door probe 110 is pivotally mounted to the door to allow the probe to pivot in the vertical direction. A biasing spring is operative to bias the probe 110 in the downward direction. The door and the probe biasing spring are similar in structure to those used in the first second embodiments and are therefore not shown. The probe 110 comprises bearing surfaces 111, 112, 113, 114 and is operative, when fully inserted in the switch 120, to actuate the switch 120.

The switch 120 is positioned and aligned to engage the door probe and comprises a housing 121 with a locking member 122 positioned on the upper and lower external edges of the housing 121. The locking member 122 is integral with and extends from the housing 121 to define end 123 and a crest 124. The locking member 122 formed from resilient material to allow the unattached end 123 to be flexed.

The switch 120 is inserted into an aperture of the door jamb 104. During the insertion, the locking members 122 a slightly upwardly and downwardly, respectively, by the edge of the door jamb 104 until the edge clears the crests 124 of the locking members 122. The locking members 122 thereupon spring downwardly and upwardly, respectively, locking the switch 120 in position.

The switch 120 further comprises a probe guide 125, a latch 190, an actuator 170, a first set 138 of contact blades 140, 142, 144 and a second set 139 of contact blades 146, 148. The probe guide 125 comprises an upwardly sloping guide surface 126 and a guide crest 127. The guide surface 126 is integral with the 121 and cooperates with the door probe spring to guide the door probe 110 upwardly during insertion downwardly during removal of the probe 110. The crest 127 is also integral with the housing 121 and cooperates with the door probe spring and probe bearing surface 114 to guide the door probe 110 downwardly during insertion and upwardly during removal of the probe 110.

The latch mechanism 190 comprises a latch 191, a pivot pin 19 and a biasing spring 193. The latch 191 comprises first and second bearing surface 194, 195 and is pivotally mounted to the housing 121 by the pivot pin 192. The latch 191 is adapted to pivot between a locking and an unlocking position and is biased to the locking position on by the spring 193.

Each contact blade 140, 142, 144, 146, 148 is formed from flexible electrically conductive material and defines a first and second end. The first end of each contact blade 140, 144, 146, 148 comprises a contact point 141, 147 149, 151, respectively. The first end of the contact blade 142 comprises two contact points 143, 145 on respective sides of the blade. The contact point 141 is aligned opposite the contact point 143; the contact point 147 is aligned opposite the contact point 145; and the contact point 151 is aligned opposite the contact point 149.

The second ends of the contact blades 140, 142, 144, 146, 148 extend rearwardly from the casing 121 for electrical connection. The contact blades 140, 142, 144, 146, 148 are firmly held in the housing 121 at the region proximate the second end and are grouped into the two sets 138, 139.

An actuator 170 is pivotally mounted to the housing 121 by a pin 175 and is positioned with respect to the probe guide 125 so as not to be visible from outside the oven. The actuator 170 comprises a bearing surface 171, a first bearing post 172, a second bearing post 173, a safety post 176 and an insulating barrier 174. The first bearing post 172 is positioned to engage the upward side of the contact blade 146. The second bearing post 173 is positioned to engage the downward side of the contact blade 142. The post 173 is clearly shown in FIG. 12*a* which is a sectional representation of the switch 120 taken along the lines 12*a*–12*a* of FIG. 12. The blade 146 applies sufficient biasing force to 170 to overcome the biasing force of the contact blade 142 and maintain the actuator 170 in the position when the door is in the open position. The insulating barrier 174 maintains electrical isolation between the first and second sets 138, 139 of contact blades.

The contact blades 140, 144 are shaped such that the blade 140 biased downwardly and the blade 144 is biased upwardly. Stop pins 164, 165 protruding outwardly from the back portion of the switch housing 121 are positioned limit the downward travel of the blade 140 and the upward travel of the blade 144 by engaging tabs 156, 157, respectively. Similarly, a stop pin 166 and a 158 located on the contact blade 148 are operative to limit upward travel of the blade 148. The tabs 156, 157, 158 are shaped and function similarly to the tabs 57, 58, 59 of the first preferred embodiment. The contact blades become slightly twisted by engagement with the stop pins, as discussed above. The second bearing post 173 is located on an extension of the actuator 170 passes, without engagement, under the contact blade 142. The contact blade 142 is shaped and positioned to be biased against the pin 173.

The switch 120 is electrically connected in the microwave oven as shown in FIG. 20. As mentioned above, the oven 1 two switches 120. The contact blades 146, 148 of the upper and lower switches 120 function as the secondary and primary switches, respectively; the contact blades 140, 142 of the upper and lower switches 120 function as the monitor and logic switches, respectively; and the contact blades 142, 144 of the upper and lower switches 120 may be used to control other functions.

The order of electrical alteration of the secondary, primary, monitor and logic switches is identical to that described with respect to the first embodiment. Although the primary and secondary switches are located on separate switches, any difference in actuation time of the two switches is slight compared with the difference contact alteration time of the sets 138, 139 of of each switch. As can be seen from the circuit in FIG. 20, the functions of the primary and secondary switches are duplicative and their order of alteration arbitrary. Therefore, within certain limits, the timing of operation between the upper and lower switches 120 is relatively noncritical. For this reason, an purposes of clarity, the description of the operation of the switches 120 will be limited to only one switch 120.

When the door is in the opened position, the actuator 170 is locked in its rest position by means of the latch mechanism 190. In this position, the actuator 170 forces the contact blade 142 to flex upwardly by engagement with the second bearing post 173. This results in electrical contact between the contact blades 140, 142 and no electrical contact between the contact blades 142, 144. Additionally, with the actuator 170 in its rest position, the contact blade 146 is electrically disconnected from the contact blade 148.

As the door is swung from the opened to the closed position, the door probe bearing surface 114 enters the probe guide 125 and is engaged by the guide crest 127. The probe 110 is guided upwardly until the bearing surface 111 the probe 110 passes over the guide crest 127, shown in FIG. 12. The probe bearing surface 114 thereupon engages the guide crest 127, allowing the probe 110 to move downwardly under the influence of the biasing spring. Upon further insertion, the probe 110 engages the bearing surface 171 of the actuator which is locked into its rest position by the latch 191.

The latch 191 maintains the actuator 170 in the rest position the probe bearing surface 111 engages the bearing surface 194 of the latch 191 and pivots the latch 191 about the pivot pin 192 a sufficient amount to release the actuator 170. Upon release of the actuator 170, shown in FIGS. 13 and 13*a*, the biasing force of the probe spring is sufficient to quickly pivot the released actuator 170 about the pivot pin 175. The pivotal movement of the actuator 170 causes the electrical alteration of the contact blades 140, 142, 144, 146, 148 in a predefined order. The contact blades 140 (monitor—upper switch, logic—lower switch) are first; then the contact blades 142, 144 are connected; and finally the contact blades 146, 148 (secondary—upper switch, primary—lower switch) are connected. Unnecessary downward movement of the probe 110 is prevented by the engagement of the crest 127 with the bearing surface 113. The latch 191 is prevented from pivoting rearwardly into engagement with the contact blades 140, 142, 144 by the safety post 176.

When the door is swung from the closed to the opened position, the probe 110 is guided upwardly by engagement with the guide crest 127. The reduced force on the bearing 171 of the actuator 170 is sufficient to allow biasing force of the flexed contact blade 146 the first bearing post 172 to force the actuator 170 upwardly. The removal of the probe 110 from the bearing surface 194 also allows the biasing spring 193 to pivot the latch 191 forwardly. However, as the actuator 170 pivots upwardly the bearing surface 171 engages the bearing surface 195 forcing the latch 191 to pivot rearwardly a sufficient distance to allow the actuator 171 to its rest position. The latch 191 is then pivot forwardly to lock the actuator 170 in place. The upward movement of the actuator 170 results in the electrical disconnection of the contact blades 146, 148 first; then the contact blades 142, 144 are disconnected and finally the contact blades 142, 140 are connected.

The shape of the contact blades of this embodiment are less determinative of the ordering of electrical alteration than in the above described embodiments. This less critical allows the blades to be manufactured less expensively. Additionally, by using two switches, the door probes may be separated a greater distance to more fully ensure a complete closure of the door. The use of switches also enables the size of each switch and final oven assembly cost to be reduced.

Figure 14:
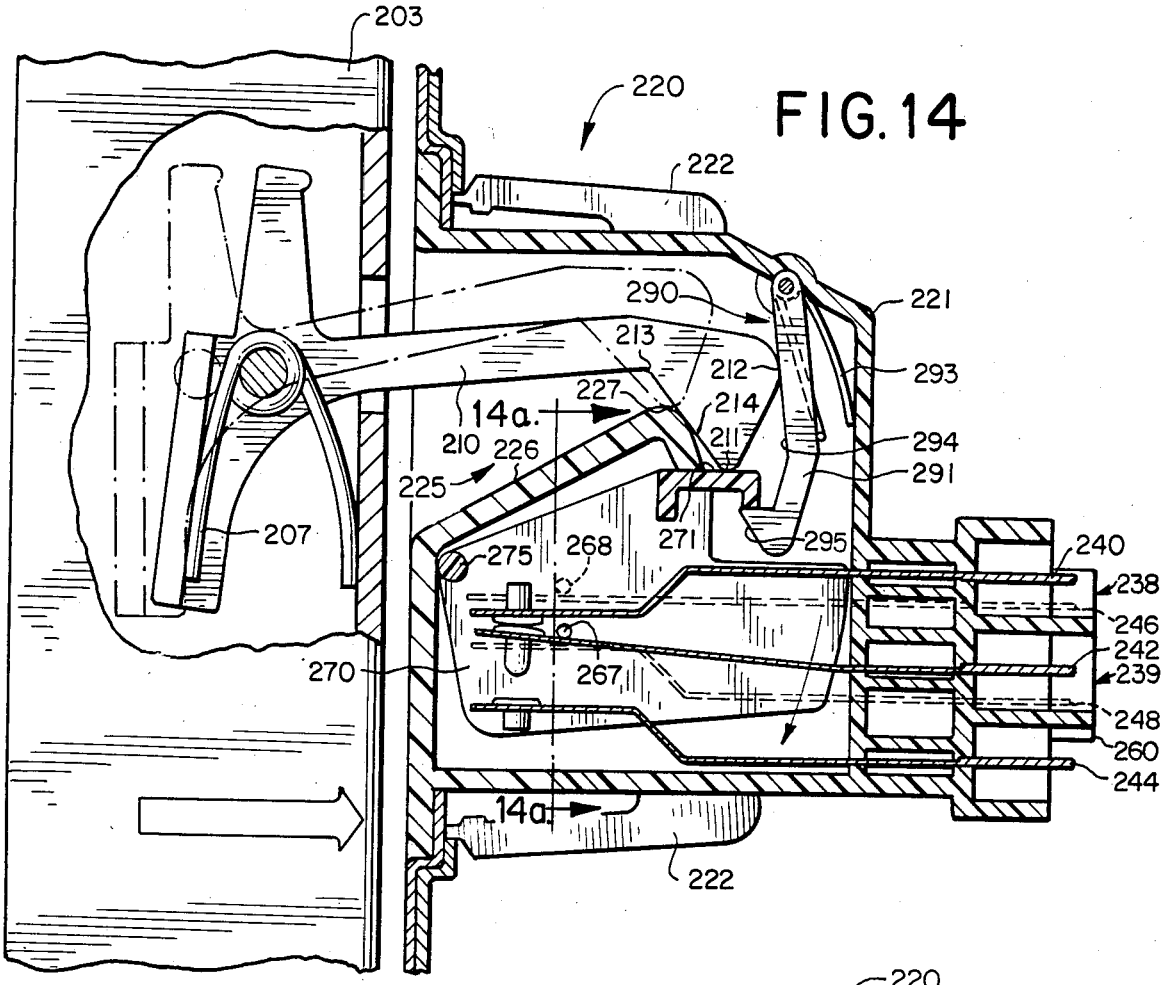
FIG. 14 is a sectional representation of a fourth preferred embodiment of the present invention shown with the door probe in the process of being inserted into the probe guide.
Figure 14A:
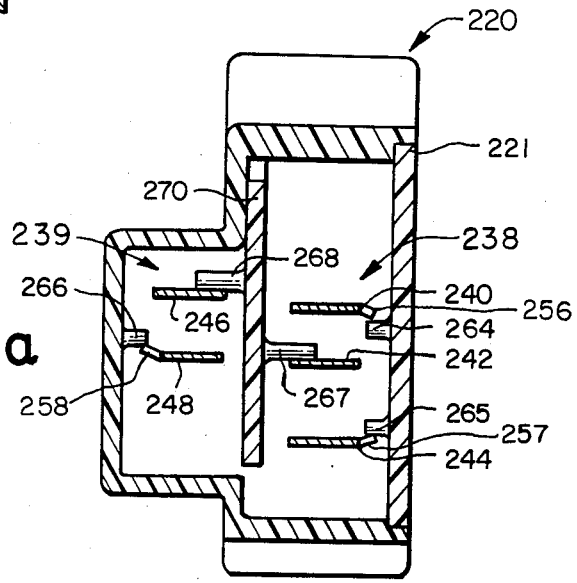
FIG. 14*a* is a sectional representation of the embodiment of FIG. 14 taken along lines 14*e*–14*a*.

A fourth embodiment, generally represented as switch 220, is shown in FIGS. 14 and 14*a*. The switch 220 comprises a guide 225, a latch mechanism 290, an actuator 270, locking members 222, and two sets 238, 239 of contact blades 240, 242, 244 and 246, 248, respectively. The probe guide 225, latch mechanism 290, locking members 222 and contact blades 240, 242, 244, 246, 248 are similar in structure and function to their corresponding elements of the third embodiment described above and will therefore not be described in detail.

Each set 238, 239 of contacts lies in a separate plane adjacent substantially parallel to the other, as shown in FIG. 14*a*. The actuator 270 separates the two planes and acts as an electrical isolating barrier between the two sets 238, 239 of contacts. An insulating barrier 260 extends rearwardly between the ends of the contact blade 240, 242, 244, 246, 248 to provide electrical of the external electrical connections.

FIG. 14*a* is a sectional representation taken along lines 14*a*—14*a* of FIG. 14. The contact blades 240, 244 are positioned such that the blade 240 is biased downwardly and the blade 244 is biased upwardly. Each blade 240, 244 comprises a tab 256, 257. Stop pins 264, 265 protruding from the inner surface of the front cover of the housing 221 are positioned to limit the downward travel of the blade 240 and the upward travel of the blade 244 by engagement with the tabs 256, 257. The contact blade 248 is positioned such that the blade 248 is biased upwardly. A stop pin 266 extending from the inner surface of the back cover is positioned to limit the upward travel of the blade 248 by engagement with a tab 258 located on the blade 248. The tabs 256, 257, 258 are shaped and function similarly to the tabs 57, 58, 59 of the first embodiment. The stop pins 264, 265, 266 are operative to provide the engaging contact blades 240, 244, 248 with a slight twist as discussed above.

The actuator 270 is pivotally mounted to the housing 221 by a pivot pin 275, and can travel between a rest and an actuated position. The position of the actuator 270 with respect to the probe guide 225 is such that the actuator 270 cannot be seen from outside the oven. The actuator 270 comprises bearing posts 267, 268 to move the contact blades 242, 246, respectively. The contact blades 242, 246 are positioned such that they are biased against the posts 267, 268. The biasing forces supplied by the contact blades 242, 246 are sufficient to maintain the actuator 270 in its rest position when not engaged by the door probe 210.

The electrical connection of the switch 220 to the oven circuitry is identical to that of the third embodiment. The contact blades 246, 248 of the upper and lower switches 220 function as the secondary and primary switches, respectively; the contact blades 240, 242 of the upper and lower switches 220 function as the monitor and logic switches, respectively; and the contact blades 242, 244 of the upper and lower switches 220 may be used to control additional functions. The order of electrical alteration of the secondary, primary, monitor and logic switches is identical to that described with respect to the first embodiment.

The timing and operation of the upper and lower switches 220 is also similar to that of the third embodiment. Therefore, for purposes of clarity the description of the operation of the switch 220 will be limited to only one switch.

When the door 203 is in the opened position, the actuator 270 is biased to its rest position by the contact blades 242, 246. In this position, the contact blades 240, 242 are in electrical contact; the contact blades 242, 244 are not in electrical contact; and the contact blades 246, 248 are not in electrical contact.

As the door 203 is swung from the opened to the closed position, the door probe 210 enters the probe guide 225 and is engaged by the guide surface 226. The probe 210 is guided upwardly until the bearing surface 211 of the probe 210 passes the crest 227. The probe bearing surface 214 thereupon engages the guide crest 227, allowing the probe 210 to move downwardly under the influence of the probe biasing spring 207. Upon further insertion, the probe 210 engages the bearing surface 271 of the actuator 270 which is locked in its rest position by the latch 291.

The actuator 270 is held by the latch 291 until the bearing surface 213 is substantially positioned over the crest 227. Once the actuator 270 is released due to engagement of the bearing surface 294 with the bearing surface 212, the probe 210 forces the actuator 270 to quickly pivot from its rest position to an actuated position. The movement of the actuator 270 is rapid and results in the rapid movement of the contact blades 242, 246. The shape and positioning of the blades 240, 242, 244, 246, 248 is such that the contact blades 240, 242 are disconnected first; then the contact blades 242, 244 are connected; and finally the contact blades 246, 248 are connected.

When the door 203 is swung from the closed to the opened position, the probe 210 is guided by engagement with the guide crest 227. The actuator 270 is pivoted upwardly under the biasing force of the contact blades 242, 246. The removal of the probe 210 from the bearing surface 294 also allows the biasing spring 293 to pivot the latch 291 forwardly. However, as the actuator 270 pivots upwardly the bearing surface 271 engages the bearing surface 295 forcing the latch 291 to pivot rearwardly a sufficient distance to allow the actuator 271 to return to its rest position. The latch 291 is then free to pivot forwardly to lock the actuator 270 in place. The upward movement of the actuator 270 results in the disconnection of the contact blades 246, 248 first; then the disconnection of the contact blades 242, 244; and finally the connection of the contact blades 240, 242.

When the probe 210 is removed, the biasing force of the contact blade 242, 246 forces the actuator 270 to return to its rest position where it is locked in position by the latch 291. The actuator 270 is operative to electrically isolate the contact blades 240, 242, 244 from the contact blades 246, 248.

As in the third embodiment, the contact blades of the fourth embodiment are substantially identical to one another and may be manufactured at a reduced cost over those of the first and second embodiments. Additionally, the contact blades of the fourth embodiment are arranged such that the fourth embodiment is smaller than the third embodiment.

Figure 15:
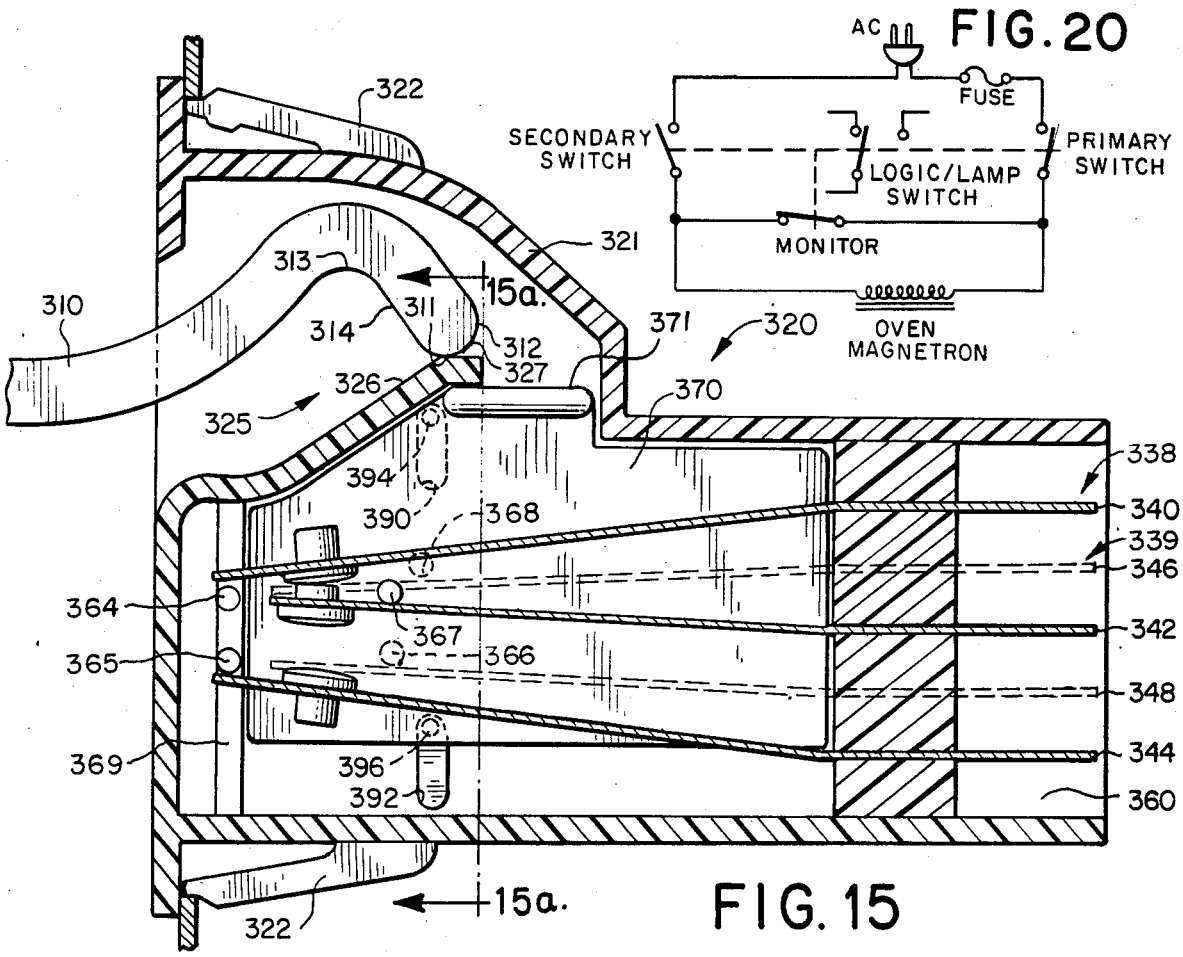
FIG. 15 is a sectional representation of a fifth preferred embodiment of the present invention shown with the door probe partially inserted into the probe guide.
Figure 15A:
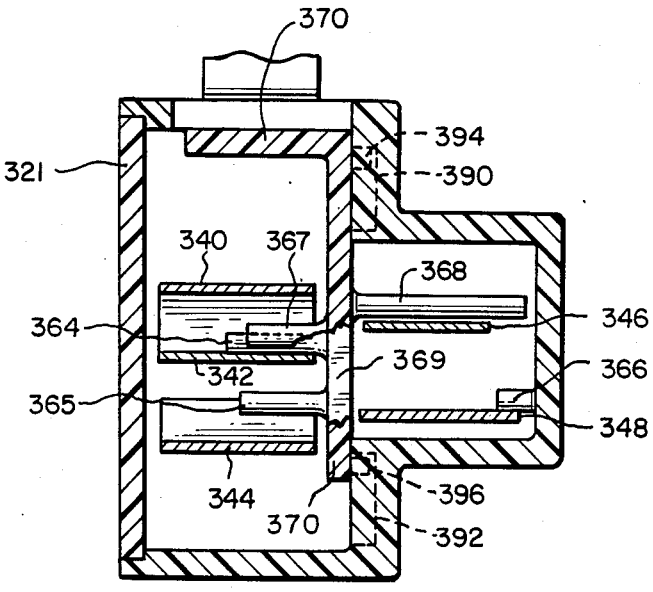
FIG. 15*a* is a sectional representation of the embodiment of FIG. 15 taken along lines 15*a*—15*a* with the contact points removed.

A fifth preferred embodiment is shown in FIG. 15 and 15*a* and generally represented as switch 320. The door probe 310 is comprised of resilient material and is fixedly mounted to the door of the oven. The probe 310 comprises bearing surfaces 311, 312, 313 and is operative, when substantially fully inserted, to actuate the switch 320. The switch 320 is positioned and aligned to engage the door probe 310 and comprises a housing 321 with locking members 322. The locking members 322 are similar in structure and function to locking members 122 described above.

The switch 320 comprises a probe guide 325, an actuator 370 and two sets 338, 339 of contact blades 340, 342, 344 and 346, 348, respectively. The actuator 370 is positioned with respect to the probe guide 325 so as not to be visible from outside the oven. The probe guide 325 and contact blades 340, 342, 344, 346, 348 are similar in structure, orientation and function to their corresponding elements of the third embodiment and will therefore not be described in detail. Each set 338, 339 of contacts lies in a separate plane adjacent the other as shown in FIG. 15*a*. The actuator 370 separates the two planes and acts as an electrical isolating barrier between the two sets 338, 339 of contacts. An insulating barrier 360 extends rearwardly between the ends of the contact blades 340, 342, 344, 346, 348 to provide electrical isolation of the electrical connections.

An isolating barrier 369 extends substantially perpendicular to the contact blades and is integral with the housing 321. The barrier 369 cooperates with the actuator 370 to substantially isolate the two sets 338, 339 of contacts. The contact blades 340, 344 are positioned such that the blades 340, 344 are biased in the downwardly and upwardly direction, respectively. Stop pins 364, 365 extending from the isolating barrier 369 are positioned to limit the travel of the contact blades 340, 344 in the downwardly and upwardly directions, respectively. A stop pin 366 extends from the back cover of the housing 321 to limit the travel of the contact blade 348.

The housing 321 comprises the guide channels 390, 392 located in the inner surface of the back cover. The channels 390, 392 are more clearly illustrated in FIG. 15*a* which shows a sectional representation of the switch 320 taken along lines 15*a*—15*a* with the contact points removed for clarity. The channels 390, 392 are oriented such that their longitudinal axes are substantially perpendicular to the longitudinal axes of the contact blades 340, 342, 344, 346, 348. Guide posts 394, 396 extend from the actuator 370 and are adapted to engage the guide channels 390, 392. The guide channels 390, 392 cooperate with the guide posts 394, 396 to guide the actuator 370 along a guide path between a rest and an actuated position.

The actuator 370 comprises bearing posts 367, 368 for engagement with the contact blades 342, 346, respectively. The contact blades 342, 346 are shaped and positioned such that they are biased against the bearing posts 367, 368, respectively. The biasing forces are sufficient to maintain the actuator 370 in its rest position when the actuator 370 is not engaged by the door probe 310.

The electrical connection of the switch 320 and the order of electrical alteration of the contact blades are identical to that of the third preferred embodiment and will therefore not be discussed in detail. When the actuator 370 is in its rest position the contact blades 340, 342 are connected; the contact blades 342, 344 are disconnected; and the contact blades 346, 348 are disconnected.

The operation of the switch 320 is similar to that of the above described preferred embodiments. When the door is swung from the opened to the closed position, the door probe 310 enters the probe guide 325. The bearing surface 311 engages the guide surface 326 and forces the door probe 310 to flex upwardly. The flexing continues until the bearing surface 311 passes over the crest 327. As the probe bearing surface 314 engages the crest 327, the probe 310 is permitted to unflex, causing the engaging end of the probe 311 to move downwardly. When the probe 311 has sufficiently entered the switch 320, the bearing surface 311 engages the actuator bearing surface 371 forcing the actuator 370 to move along the guide path defined by the guide channels 390, 392. The probe 310 is also limited in its downward movement by engagement of the bearing surface 313 with the crest 327.

The movement of the actuator 370 along the guide path forces the contact blades 342, 346 to flex downwardly. The positioning of the contact blades is such that the contact blades 340, 342 are disconnected first, then the contact blades 342, 344 are connected; and finally the contact blades 346, 348 are connected.

When the door is swung from the closed to the opened position, the end of the probe 310 is flexed upwardly by engagement of the guide crest 327 with the probe bearing surface 314. Once the probe 310 has passed over the crest 327, the probe 310 engages the guide surface 326 which permits the probe 310 to unflex to its original position. With the probe 310 removed, the biasing force of the contact blades 342, 346 moves the actuator 370 along the guide path to its rest position. The movement of the actuator 370 produces alterations in the electrical connections of the blades 340, 342, 344, 346, 348. The contact blades 346, 348 are disconnected first; then the contact blades 342, 344 are disconnected; and finally the contact blades 340, 342 are connected.

This embodiment is described as operative with a door probe which is made of resilient material. The resilient material supplies sufficient biasing force when deflected to eliminate the need for the pivotal mounting and probe biasing spring of the above described door probes. Although this door probe has been described in reference to the fifth embodiment, it may be used with any of the embodiments described herein.

Figure 16:
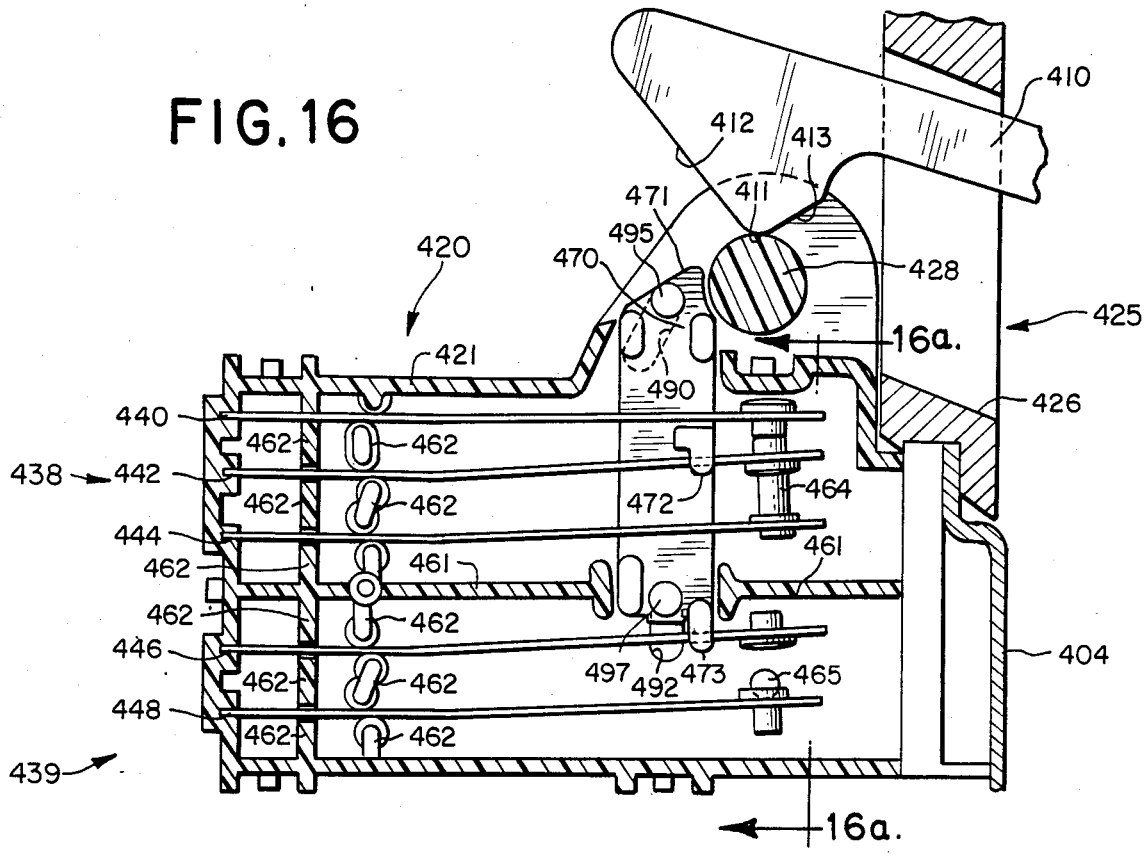
FIG. 16 is a sectional representation of a sixth embodiment of the present invention shows with the door probe partially inserted into the probe guide.
Figure 17:
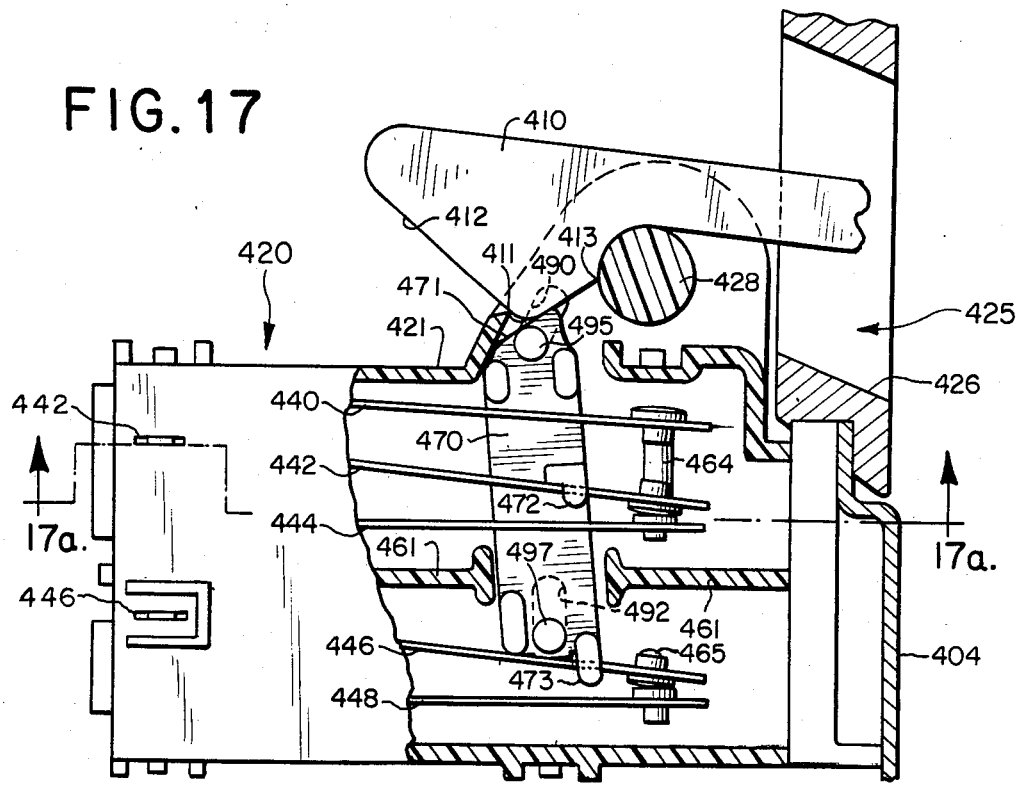
FIG. 17 is a sectional representation of the embodiment of FIG. 16 shown with the door probe fully inserted into the probe guide.

A sixth preferred embodiment is shown in FIGS. 16, 17 and generally represented as switch 420. As in the third embodiment, the door probe 410 is pivotally attached to the door by a pivot pin and is biased in a first direction by a biasing spring. The pivot pin and probe biasing spring are similar in structure and function to those of the above embodiments and are therefore not shown. The probe 410 comprises bearing surfaces 411, 412, 413 and is operative, when fully inserted, to actuate the switch 420. The switch 420 is fastened in the oven in a conventional manner using a clip style fastener, not shown.

A probe guide 425 is aligned with the probe 410 and positioned in the aperture of the door jamb 404. The guide 425 comprises an upwardly sloping guide surface 426 to guide the probe 410 upwardly and into engagement with the switch 420. The switch 420 is positioned and aligned to engage the door probe 410 and comprises a housing 421 and a guide wheel 428. The guide wheel 428 is conventionally rotatably mounted to the housing 421 by means of a pivot pin not shown.

The switch 420 comprises an actuator 470, a first set 438 of contact blades 440, 442, 444 and a second set 439 of contact blades 446, 448. The actuator 470 is positioned with respect to the probe guide 425 so as not to be visible outside the oven. The contact blades are similar in structure and function to those of the third embodiment and will therefore only be described briefly.

Figure 16A:
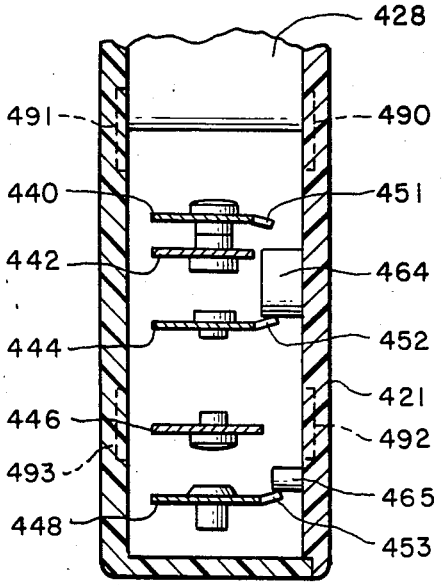
FIG. 16*a* is a sectional representation of the embodiment of FIG. 16 taken along lines 16*a*–16*a*.
Figure 17A:
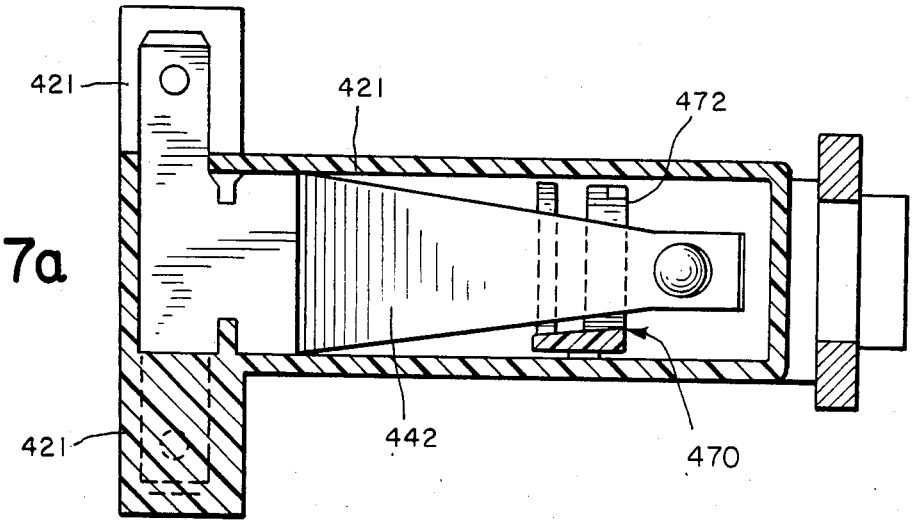
FIG. 17*a* is a sectional representation of the embodiment of FIG. 17 taken along lines 17*a*—17*a*.

The contact blades 440, 442, 444, 446, 448 are divided into the two sets 438, 439 by the isolating barrier 461 and the actuator 470. Each blade defines a first and second end. The first end comprises a contact point and the second end is adapted for external electrical connection. The second ends of each blade extend perpendicularly to the longitudinal axis of the blades as shown in FIG. 17*a*. The second ends of the contact blades 442, 446 extend upwardly and the second ends of the contact blades 440, 444, 448 extend downwardly. The housing 421 protrudes about the second end 446, 448 for electrical isolation. A plurality of protrusions 462 extend outwardly from the back cover of the housing 421 to firmly hold and electrically isolate the contact blades 440, 442, 444, 446, 448 at the region proximate their second ends. The contact blades 440, 444 are positioned such that the blades are biased downwardly and upwardly, respectively. The contact blades 440, 444, 448 each comprise a tab 451, 452, 453, shown in FIG. 16*a*. The tabs 451, 452, 453 are shaped and function similarly to the tabs 57, 58, 59 of the first embodiment. FIG. 16*a* is a sectional representation of the switch 420 taken along lines 16*a*—16*a* of FIG. 16. For clarity, FIG. 16*a* is shown with the actuator 470 removed. An elongated stop pin 464 is positioned to limit movement of the blades 440, 444 in the respective directions by engagement with the tabs 451, 452. Similarly, the contact blade 448 is positioned such that the blade is biased upwardly. A stop pin 465 is positioned to limit the upward movement of the blade 448 by engagement with the tab 453. The stop pins 464, 465 provide a slight degree of twist to the contact blades 440, 444, 448 as described above.

Figure 18:
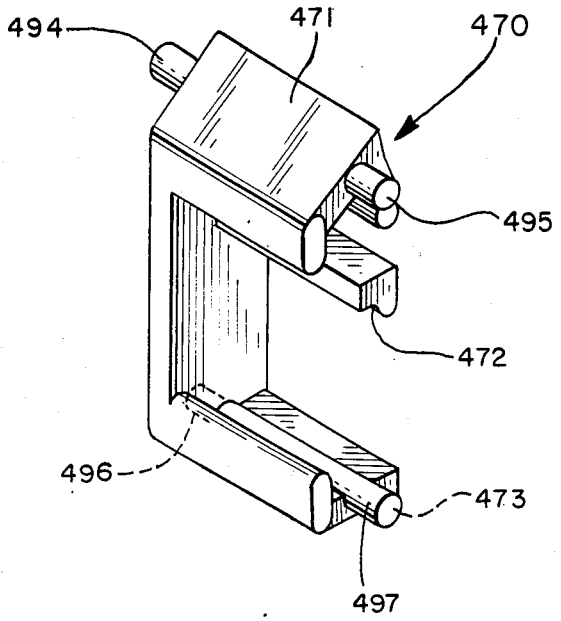
FIG. 18 is a perspective view of the actuator shown in FIG. 16.

The actuator 470 comprises bearing surfaces 471, 472, 473 for engagement with the door probe bearing surface 411 and the contact blades 442, 446, respectively. The actuator 470, shown in FIG. 18 in perspective, further comprises two guide pins 494, 496 on the lower surface and two guide pins 495, 497 on the upper surface. The guide pins 494, 496 are adapted for engagement with two elongated guide channels 490, 492 located in the back cover of the housing 421. The guide pins 495, 497 are adapted for engagement with two elongated guide channels 491, 493 located in the front cover of the housing 421. The guide channels 490, 491, 492, 493 are operative to guide the actuator 470 along a guide path between a rest position and an actuated position.

When the actuator 470 is not engaged by the door probe 410, the actuator 470 is biased to its rest position by the contact blades 442, 446. In this position, the contact blades 440, 442 are in electrical contact; the contact blades 442, 444 are not in electrical contact; and the contact blades 446, 448 are not in electrical contact.

As the door is swung from the opened to the closed position, the door probe 410 enters the probe guide 425. The bearing surface 411 engages the guide surface 426 and forces the probe, 410 upwardly. Further guidance of the probe 410 is provided by the guide wheel 428 which also engages the bearing surface 412. The probe 410 is guided upwardly until the bearing surface 411 engages the guide wheel 428. The probe 410 is then permitted to move downwardly allowing the probe 410 to engage the bearing surface 471 of the actuator 470. The force of the probe 410 is sufficient to overcome the biasing force of the contact blades 442, 446 and move the actuator along the guide path defined by the guide channels 490, 491, 492, 493.

The movement of the actuator 470 causes the contact blades 442, 446 to flex downwardly. The shape and position of the contact blades is such that the contact blades 440, 442 (monitor-upper switch, logic-lower switch) are disconnected first; then the contact blades 442, 444 are connected substantially simultaneously with the connection of the contact blades 446, 448 (secondary-upper switch, primary-lower switch). The ordering of contact alteration is different from that of the previous embodiments in that the contacts 442, 444, 446, 448 are altered simultaneously. The simultaneity is mandated by the use of the switch in a particular application and is illustrative of the versitility of the embodiment.

When the door is swung from the closed to the opened position, the probe 410 is forced upwardly by the guide wheel 428. Once the bearing surface 411 of the probe 410 has passed over the wheel 428 the probe is allowed to move downwardly. With the probe 410 removed, the biasing force of the contact blades 442, 446 moves the actuator 470 along the guide path to its rest position. The movement of the actuator 470 produces orderly movement of the contact blades. The contact blades 442, 444 and substantially simultaneously the contact blades 446, 448 are disconnected first and finally the contact blades 440, 442 are connected.

The sixth preferred embodiment reduces the friction between the door probe 410 and the guide surfaces of the switch 420 by means of the guide wheel 428. The door probe 410 is releasably held in its fully inserted position by the cooperation of the guide wheel 428 and the indented guide surface 413. Also, in this embodiment the contact blades 442, 446 travel in a direction different from the direction of maximum travel of the probe bearing surface 411. This embodiment has the unique feature of guiding the actuator in a manner so as to move the contact blades 442, 446 in response to the direction of maximum travel of the door probe 410.

In all of the preferred embodiments, the probe guides and the probes cooperate to produce an initial resistance to the closing of the door and then aid in closing the door through biased movement of the door probes. Similarly, upon opening the door, the probe guides and probes cooperate to produce an initial resistance and then aid in the opening of the door. The resistance to the opening of the door eliminates the need for a door latch and therefore reduces the manufacturing costs of the appliance. Additionally, the contact connectors 84, although only described in reference to the first embodiment, may be used with any of the preferred embodiments. Furthermore, the housing of the embodiments may be adapted about the second ends of the contact blades such that only certain sized and shaped connectors may be connected to certain contact blades. This adaptation reduces wiring errors during switch installation. It should also be understood that, although the embodiments of the present invention have been shown installed in a microwave oven, the present invention may be used with a variety of appliances including but not limited to photocopiers, washers, dryers, dishwashers, computer equipment and the like.

By way of illustration, and with no limitation intended, the following information is given to define the preferred embodiments in greater detail. In the preferred embodiments the contact blades are formed from #220 CDA commercial bronze and measure approximately 0.010 inches in overall thickness with the second end measuring approximately 0.020 inches in thickness. The contact points, other than the contact points 41, 43, comprise a 0.093–0.156 inch diameter contacting surface formed from a silver and cadmium oxide alloy and are riveted to the respective contact blades. The contact points 41, 43 comprise nickel alloy with a gold contact surface and measure approximately 0.030 inches in height, 0.030 inches across the base and 0.100 inches in length and are welded to the respective contact blades 40, 42. The housing 21, 121, 221, 321, 421; the insulating barriers 60, 160, 260, 61, 62, 63; and the probe guides 25, 30, 125, 225, 325, 425 are formed from nonconductive UL flame rated #94VO plastic. The door probes 10, 15, 110, 210, 410 are formed from acetal plastic and measure approximately 2.0 inches in length, ⅜ inches in width and 0.100 inches in thickness. The door probe 310 is also formed from acetal plastic and measures approximately 2.0 inches in length, ⅜ inches in width and 0.250 inches in thickness. The latch 91, 191, 291 is formed from acetal plastic and measures approximately ¾ inches in length, 3/16 inches in width and 3/16 inches in thickness. The guide wheel 428 is formed of acetal plastic and measures approximately 0.250 inches in diameter.

It should be understood that materials or components different from those used in the preferred embodiments may be selected to reduce the cost or to increase the durability of the apparatus. The foregoing detailed description has been given for illustration purposes only. A wide range of changes and modifications can be made to the preferred embodiments described above. One such modification is shown in FIG. 11 wherein the electrical connector 84 is formed integral with a contact blade to reduce the number of contact type electrical connections. Another modification would be to alter the shape of the contact blades so that certain contact blades are engaged and moved by the respective actuators before other contact blades are engaged and moved by the actuators. Additionally, the shape of the contact blades could be altered so that certain blades are normally contacted or not contacted when the actuators are in particular positions. These and other changes can be made without departing from the spirit and the scope of the invention and without diminishing its attendant advantages. It should be understood that it is the following claims, including all equivalents, which are intended to define the scope of this invention.

We claim:

1. In a switch of the type actuatable by at least one biased probe, the improvement comprising:

a plurality of contacts, at least one contact capable of being moved between a first and second position, the first position being that the movable contact is in electrical communication with at least one other contact, the second position being that the movable contact is not in electrical communication with the at least one other contact;

at least one actuator positioned to engage at least the movable contact and operative under biased engagement with the probe to move the movable contact from one of the first and second positions to the other of said the first and second positions by movement of the actuator between an actuated and a nonactuated position; and a latch adapted to releasably engage the actuator when the actuator is in the nonactuated position and prevent movement of the actuator to the actuated position;

the latch and probe cooperating to prevent release of the actuator by the latch unless the latch is sufficiently engaged by the probe.

2. The invention of claim 1 wherein the plurality of contacts are grouped into at least two sets, each set comprising at least to contacts, the improvement further comprising at least one electrical insulating barrier disposed between the two sets of contacts.

3. The invention of claim 1 wherein the improvement comprises means for substantially preventing movement of selected ones of the contacts.

4. The invention of claim 1 wherein selected ones of the contacts each comprise an elongated, flexible blade, each blade defining a first end adapted for electrical contact with other ones of the contacts and a second end adapted for electrical connection external to the switch and wherein the region proximate the second end is secured to allow the first end to flex between the first and second positions.

5. The invention of claim 1 wherein the actuator comprises a probe engaging surface adapted to engage the probes wherein the at least one contact is capable of traveling in a substantially second direction between the first and second positions; wherein the region of the probe which engages the actuator travels in a third direction different from the second direction; and wherein the improvement further comprises means for guiding the actuator in a manner such that the travel of the at least one contact in the second direction is maximized.

6. The invention of claim 1 wherein the probe is biased against movement in a first direction; and wherein the improvement further comprises:

at least one probe guide, the probe guide defining a region of visual access and positioned with respect to the actuator such that the actuator lies outside the region of visual access, the probe guide operative to move the probe in the first direction against the probe biasing force as the probe is inserted into the switch, the probe guide further operative to guide the probe into a position of biased engagement with the actuator and to releasably confine the probe in the position.

7. The invention of claim 1 wherein the improvement further comprises:

an additional plurality of contacts, at least one additional contact capable of being moved between a first and second position, the first position being such that the additional movable contact is in electrical communication with at least one other additional contact, the second position being such that the additional movable contact is not in electrical communication with the at least one other additional contact;

the actuator positioned between and operative to electrically isolate the plurality of contacts and the additioanl plurality of contacts, the actuator adapted to engage at least the additional movable contact and operative in cooperation with the probe to move the movable contact and the additional movable contact between one of the respective first and second positions and the other of the respective first and second positions.

8. The invention of claim 7 wherein the plurality of contacts and the additional plurality of contacts define a plane and wherein the the actuator comprises a partition extending substantially perpendicular to the plane of the contacts to substantially electrically isolate the plurality of contacts from the additional plurality of contacts.

9. The invention of claim 7 wherein the plurality of contacts define a first plane and the additional plurality of contacts define a second plane substantially parallel to the first plane and wherein the actuator is positioned between and substantially parallel to the first and second planes to electrically isolate the plurality of contacts from the additional plurality of contacts.

10. The invention of claim 1 wherein the switch comprises a housing; wherein the actuator moves between a nonactuated to an actuated position to alter the electrical connection of the contact; and wherein the improvement further comprises guiding means integral with the housing and operative to guide the actuator between the nonactuated and the actuated position.

11. The invention of claim 1 wherein the switch comprises a housing and the probe guide is integral with the housing.

12. The invention of claim 1 wherein the switch comprises a housing, the improvement further comprising:

a tab located on each of the moveable contacts, each tab extending toward the housing; and at least one stop pin extending from the housing, each stop pin adapted for engagement with at least one of the tabs, the tab and stop pin operable to prevent movement of the respective contact in a predefined direction.

13. The invention of claim 12 wherein the at least one contact comprises a flexible blade which defines a longitudinal axis; wherein the tab extends from the blade perpendicular to the longitudinal axis towards the housing; wherein at least one tab is bent towards the stop pin; and wherein the moveble contact is sufficiently biased against the stop pin to twist the contact about the longitudinal axis.

14. A probe actuated switch comprising:

a biased probe;

a plurality of contacts, at least one contact capable of being moved between a first and second position, the first position being that the movable contact is in electrical communication with at least one other contact, the second position being that the movable contact is not in electrical communication with the at least one other contact;

at least one actuator positioned to engage at least the movable contact and operative under biased engagement with the probe to move the movable contact from one of the first and second positions to the other of the first and second positions to cause a change in the state of electrical communication of the movable contract;

at least on probe guide, the probe guide operative to guide the probe into biased engagement with the actuator, the probe guide positioned with respect to the actuator to define a first distance of insertion;

an additional biased probe;

an additional plurality of contacts, at least one additional contact capable of being moved between a first and second position, the first position being that the additional movable contact is in electrical communication with at least one other additional contact, the second position being that the additional movable contact is not in electrical communication with the at least one other additional contact;

an additional actuator positioned to engage at least the additional movable contact and operative under biased engagement with the additional probe to moe the additional movable contact from one of the first and second positions to the other of the first and second positions to cause a change in the state of electrical communciation of the additional movable contract; and an additional probe guide, the additional probe guide operative to guide the additional probe into biased engagement with the additional actuator, the additioanl probe guide positioned with respect to the additional actuator to define a second distance of insertion, the second distance of insertion being sufficiently less than the first distance of insertion such that the additional probe engages the additional actuator causing a change in the state of electrical communication of the additional movable contact before the probe engages the actuator causing a change in the state of electrical communication of the movable contact.

15. A probe actuated switch comprising:

a biased probe;

a plurality of contacts, at least one contact capable of being moved between a first and second position, the first position being that the movable contact is in electrical communication with at least one other contact, the second position being that the movable contact is not in electrical communication with the at least one other contact;

at at least one actuator positioned to engage at least the movable contact and operative under biased engagement with the probe to move the movable contact from one of the first and second positions to the other of the first and second positions to cause a change in the state of electrical communication of the movable contact;

at least one probe guide, the probe guide operative to guide the probe into biased engagement with the actuator, the probe guide positioned with respect to the actuator to define a first distance of insertion;

an additional biased probe;

an additional plurality of contacts, at least one additional contact capable of being moved between a first and second position the first position being that the additional movable contact is in electrical communication with at least one other additional contact, the second position being that the additional movable contact is not in electrical communication with the at least one other additional contact;

an additional actuator positioned to engage at least the additional movable contact and operative under biased engagement with the additional probe to move the additional movable contact from one of the first and second positions to the other of the first and second positions to cause a change in the state of electrical communication or the additional movable contact; and an additional probe guide, the additional probe guide operative to guide the additional probe into biased engagement with the additional actuator, the additional probe guide positioned with respect to the additional actuator to define a second distance of insertion, the second distance of insertion being substantially equal to the first distance of insertion;

wherein the actuator and the additional actuator each travel between a respective nonactuated and actuated position to alter the electrical connection of the contact and the additional contact respectively;

latching means operable to releasably hold the actuator in the nonactuated position, the latching means cooperative with the actuator, probe, the additional actuator and the additional probe to maintain the actuator in the nonactuated position until the additional actuator has altered the electrical connection of the at least one additional contact, the latching means then operative to quickly release the actuator to allow the actuator to snap from the nonactuated to the actuated position.

16. The invention of claim 15 wherein the latching means comprises:

a pivot pin;

a latch adapted to pivot about the pivot pin; and a biasing means to bias the latch to a latching position.

17. A probe actuating a probe actuatable switch wherein the switch, is of the type comprising a contact, a probe guide which defines a region of visual access and an actuator-positioned outside the region of visual access, the actuator operable upon biased engagement with the probe to move the contact, the probe comprising:

a shank formed from resilient material such that the shank is biased to predefined shape; and an actuator engaging tip integrally connected to the shank, the tip cooperative with the probe guide to flex the shank to allow the tip to be guided by the probe guide into biased engagement with the actuator.

18. A switch of the type comprising a casing and operable by at least one probe, the probe defining a first end, the first end biased against movement in a first direction, the switch comprising:

at least one probe receptacle adapted to receive the probe, the probe receptacle comprising a probe guide;

a plurality of sets of contact blades, each set comprising a selected contact blade which defines a first end and a second end, the second end fixedly fastened to the casing, the first end capable of being flexed between a first and second position, the first position being such that the first end is in electrical communication with at least one other contact blade, the second position such that the first end is not in electrical communication with the at least one other contact blade;

at least one actuator moveably mounted to the casing and adapted to engage,the selected one contact blade of each set, the actuator capable of flexing the selected one contact blade of each set between the first and second positions by movement of the actuator between a third and fourth position, the selected ones of the contact blades operative to bias the actuator to one of the third and fourth positions;

a latch defining a first end, the first end adapted to releasably engage and prevent movement of the actuator when the actuator is in the biased one of the third and fourth positions;

the probe guide, actuator and latch operative to move the probe in the first direction against the probe biasing force as the probe is inserted into the probe receptacle past the probe guide and into engagement with the actuator and latch, the actuator and latch are further operative when the probe receptacle is sufficiently engaged by the probe to release the actuator and allow the probe under the influence of the probe biasing force to move the actuator from the biased one of the third and fourth positions to the other one of the third and fourth positions so as to alter the electrical connection of the selected ones of the contacts in a preselected order.

19. In a microwave oven having a housing defining a microwave cooking cavity, a door for closing the cavity and a switch for applying power to the oven, the improvement comprising:

probe means carried on said door;

means for pivotally biasing said probe means;

switch means of said housing for engaging said probe means to latch said door and apply power to the microwave oven when the door is closed, said switch means including actuator means for moving between a door open position and a door closed position in response to the opening and closing of said door;

electrical contact means responsive to movement of the actuator means for applying power to the microwave oven when the actuator means moves to said door closed position and disconnecting power when the actuator means moves to the door open position;

latch means for holding said actuator means in said door open position when the door is open and while the door is closing and for releasing said latch means to allow it to move to said door closed position when the door is closed; and means for guiding said probe means within the switch means and pivoting the probe means against its bias as the door is being closed and, when the door is closed, engaging the probe means to latch the door; said probe means moving said latch means to release said actuator means and pivoting against the actuator means under said bias when the door is closed to rapidly snap the actuator means to said door closed position and thereby apply power to the microwave oven.

20. The microwave oven of claim 19, wherein said probe means includes two spaced probe elements and said actuator means includes two corresponding actuator elements, one of said actuator elements for cooperating with one of said probe elements to provide a first series power connection as the door is being closed and the other of said actuator elements cooperating with said latch means and the other of said probe elements to provide a second relatively rapid delayed series power connection when the door is closed, the two power connections being required to apply power to said oven.

21. The microwave oven of claim 19, wherein said actuator means is pivotally mounted for movement between a first plurality of conductive contacts on one side and a second plurality of conductive contacts on the other side; said actuator means providing an insulating barrier between the first and second plurality of contacts and pivoting in cooperation with said latch means and said probe means to selectively activate the first and seoond plurality of contacts.

22. The microwave oven of claim 19, including means for supporting said actuator means for axial and transverse movement in response to sliding contact with an end of said probe means as said door is closed, the axial and transverse movement facilitating the operation of said electrical contact means.

23. The microwave oven of claim 19, wherein said means for guiding includes, means for shielding the interior of said switch means from view.

* * * * *